US007140908B2

(12) United States Patent
Katsuma

(10) Patent No.: US 7,140,908 B2
(45) Date of Patent: Nov. 28, 2006

(54) CONNECTOR

(75) Inventor: Takatoshi Katsuma, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/128,955

(22) Filed: May 12, 2005

(65) Prior Publication Data

US 2005/0255740 A1 Nov. 17, 2005

(30) Foreign Application Priority Data

May 14, 2004 (JP) ..... 2004-145110

(51) Int. Cl.
*H01R 3/00* (2006.01)

(52) U.S. Cl. ..... 439/489

(58) Field of Classification Search ..... 439/488–489, 439/595, 352, 752.5, 357–358, 596, 752, 439/271–273, 372, 350
See application file for complete search history.

(56) References Cited

U.S. PATENT DOCUMENTS 5,145,356 A * 9/1992 Minnis ..... 439/352
5,336,101 A 8/1994 Kasugai et al.
5,651,703 A * 7/1997 Sasai ..... 439/752
5,743,760 A 4/1998 Inaba et al.
5,928,034 A * 7/1999 Tabata et al. ..... 439/595
6,409,552 B1 * 6/2002 Matsumoto ..... 439/752
6,422,894 B1 * 7/2002 Endo et al. ..... 439/489
2001/0055907 A1 * 12/2001 Murakami et al. ..... 439/595

* cited by examiner

*Primary Examiner*—Truc T. Nguyen
*Assistant Examiner*—Edwin A. Leon
(74) *Attorney, Agent, or Firm*—Gerald E. Hespos; Anthony J. Casella

(57) ABSTRACT

A female housing (21) has a cavities (24) for receiving female terminal fittings (22). A front retainer (23) is mounted on the front of the housing (21). Insertion openings (29, 41) are formed on front walls (25, 40) of the cavities (24). An upper half of the front walls (25, 40) at a lower stage are divided into a front portion (40*a*) on the front retainer (23) and a rear portion (25*a*) on the female housing (21). Insertion openings (41) in the front portion (40*a*) of the front retainer (23) have guide surfaces (42) for guiding male terminal fittings (12) therein. Insertion opening (29) in the rear portion (25*a*) of the female housing (21) have auxiliary guide surfaces (31) for guiding the male terminal fittings (12) therein.

9 Claims, 22 Drawing Sheets

CONNECTOR

BACKGROUND OF THE INVENTION

1. Field of the Invention

The present invention relates to a connector.

2. Description of the Realted Art

U.S. Pat. No. 5,336,101 and FIG. 23 herein relate to a connector. With reference to FIG. 23, the connector has a housing 1 and a terminal fitting 2 is inserted into a cavity 3 of the housing 1 from the rear. A lance 3*a* is provided in the cavity 3 for preventing removal of the terminal fitting 2 from the cavity 3. A front retainer 4 is mounted to the front of the cavity 3 and has an elastic deformation prevention portion 4*a* that advances into a flexible space of the lance 3*a* and prevents the lance 3*a* from deforming away from the terminal fitting 2. The cavity 3 has a front wall 5 formed on the front retainer 4 and a front wall 6 formed on the housing 2. Insertion openings 8, 9 are formed respectively in the front walls 5, 6 so that a mating terminal fitting 7 can advance into the cavity 3 from the front of the housing 1. A guide surface 8*a* is formed around the periphery of the front of the insertion opening 8 on the front wall 5 of the front retainer 4 for guiding the mating terminal fitting 7 into the cavity 3.

The housing 1 and the front retainer 4 are made of synthetic resin. Thus, dimensional errors occur among products when the synthetic resin is molded. As a result, the insertion opening 8 in the front retainer 4 and the insertion opening 9 in the housing 1 may not radially align. Consequently, the mating terminal fitting 7 may be caught by the peripheral portion of the insertion opening 9 in the housing 1.

The invention has been completed in view of the above-described situation. Therefore it is an object of the present invention to insert a mating terminal fitting smoothly into a cavity.

SUMMARY OF THE INVENTION

A connector according to the invention has a housing with a cavity for receiving a terminal fitting. The connector also includes a mounting member that can be mounted on a front end of the housing. The cavity has a front wall with an insertion opening for receiving a mating terminal fitting. At least a section of the front wall and the insertion opening are divided longitudinally so that the mounting member forms part of the longitudinally divided section front wall and the housing forms another part. A guide surface is formed adjacent the insertion opening and on the part of the front wall formed by the mounting member and an auxiliary guide surface is formed adjacent the insertion opening and on the front wall of the housing. The guide surface and the auxiliary guide surface are aligned for guiding the mating terminal fitting into the cavity.

The mating terminal fitting is guided into the insertion opening by the guide surface on the part of the front wall formed by the mounting member. The mating terminal fitting then is guided further into the insertion opening by the auxiliary guide surface on the part of the front wall formed by the housing. Therefore the mating terminal fitting is inserted smoothly into the cavity without being caught by the peripheral portion of the insertion opening.

The housing may be a first housing, and the mating terminal fitting may be in a second housing that has a front end and a hood that opens forward at the front end. The first housing is configured to be inserted a specified distance into the hood to connect the terminal fitting and the mating terminal fitting electrically. The longitudinal dimension of the hood could be larger than a specified longitudinal dimension of the hood. In this case, the first housing could advance forward into the hood beyond a specified depth and an improper electrical connection could be achieved between the terminal fitting and the mating terminal fitting. Accordingly the other housing has a stop to engage the front end of the hood when the first housing has advanced into the hood to a predetermined normal depth. Thus further progress of the fit-in operation is prevented. The stop is on the outer surface of the other housing and not on the deformable locking arm. Consequently, the stop positively prevents the first housing from advancing excessively into the hood.

DETAILED DESCRIPTION OF THE PREFERRED EMBODIMENTS

Figure 1:
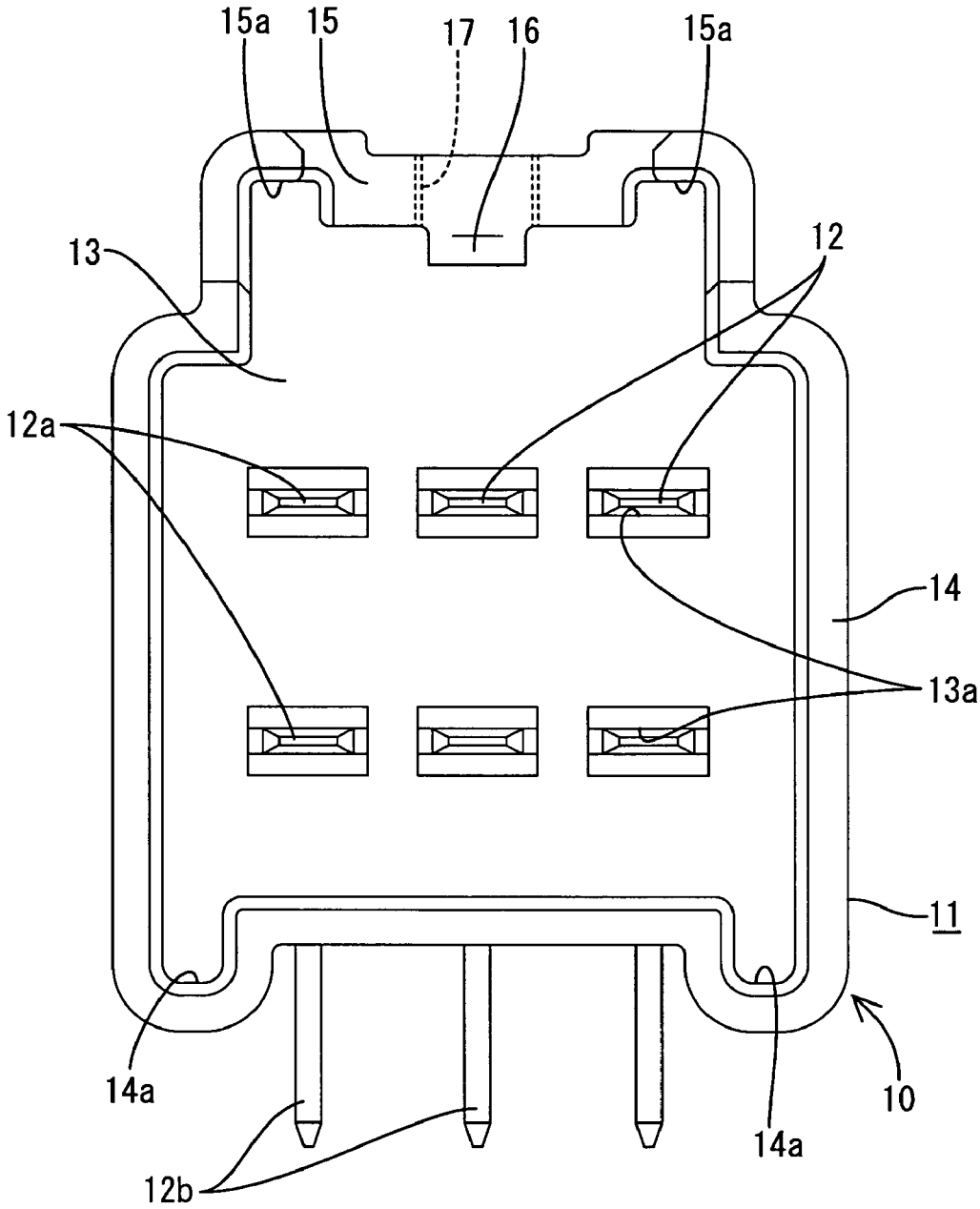
FIG. 1 is a front view of a male housing according to a first embodiment of the present invention.

A connector according to a first embodiment of the invention includes a male connector 10 and a female connector 20, as shown in FIGS. 1 through 17. In the embodiment, a female connector 20 on which a mating male connector can fit is shown. The male connector 20 has a female housing 21, a plurality (six) of female terminal fittings 22 accommodated in the female housing 21, and a front retainer 23 mounted on the female housing 21 at its front side. Ends of the connectors 10, 20 that connect together are referred to as the fronts, and the upper side in FIGS. 1 and 10 are referred to as the top.

Figure 10:
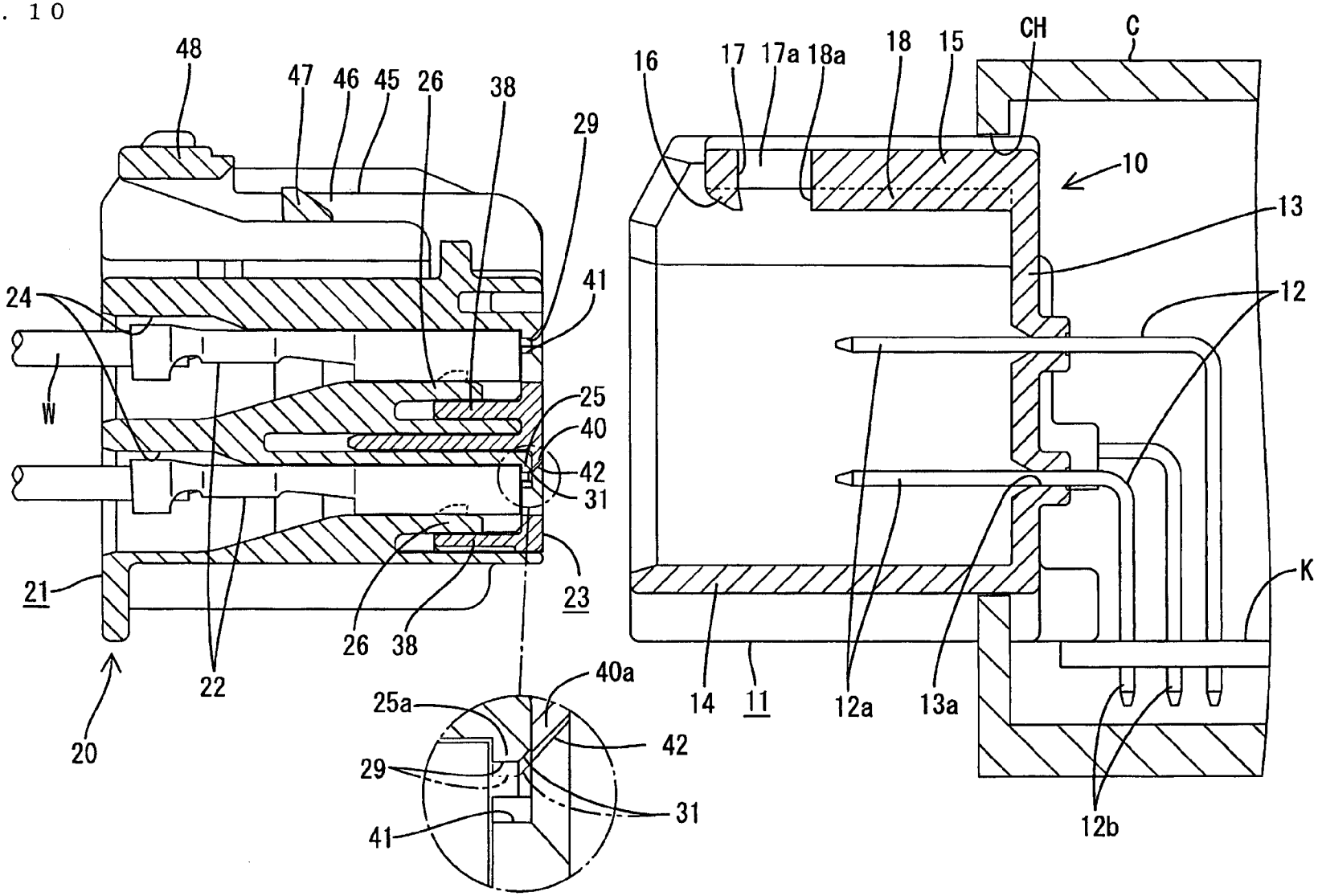
FIG. 10 is a sectional side elevation of a state before the female housing in which the front retainer is mounted on a main locking position is fitted in the male housing.

The male connector 10 penetrates through an opening CH in a front wall of the casing C and is mounted on a substrate K in a box-shaped casing C, as shown in FIG. 10. The male connector 10 has a male housing 11 and male terminal fittings 12, as shown in FIGS. 1 and 10. The male housing 11 is formed unitarily from a synthetic resin and includes a terminal fitting holder 13 and a hood 14 that projects forward from the terminal fitting holder 13. The terminal fitting holder 13 has six terminal fitting insertion holes 13*a* divided equally into upper and lower rows. The male terminal fittings 12 are inserted through the respective terminal fitting insertion holes 13*a* from the rear. Each male terminal fitting 12 is formed from metal and defines an approximately L-shape when viewed sideways. Each male terminal fitting 12 has a connector connection end 12*a* that projects horizontally into the hood 14. Each male terminal fitting 12 also has a substrate connection end 12*b* that extends vertically at the rear of the terminal fitting holder 13. The substrate connection end 12*b* extends into a hole of the substrate K for soldered electrical connection with an unillustrated electrical path. The hood 14 is a generally square tube with an open front end configured to receive a front end of the female connector 20. The upper part of the hood 14 is narrower than lower parts. The hood 14 has an upper wall 15 and two receiving grooves 15*a* are formed at the widthwise ends of an inner surface of the upper wall 15. Thus a portion of the upper wall 15 between the receiving grooves 15*a* is lower than the widthwise ends. A front end of the upper wall 15 of the hood 14 is rearward from front ends of the other peripheral walls of the hood 14. Guide grooves 14*a* are formed at both widthwise ends of a lower wall of the hood 14.

Figure 22:
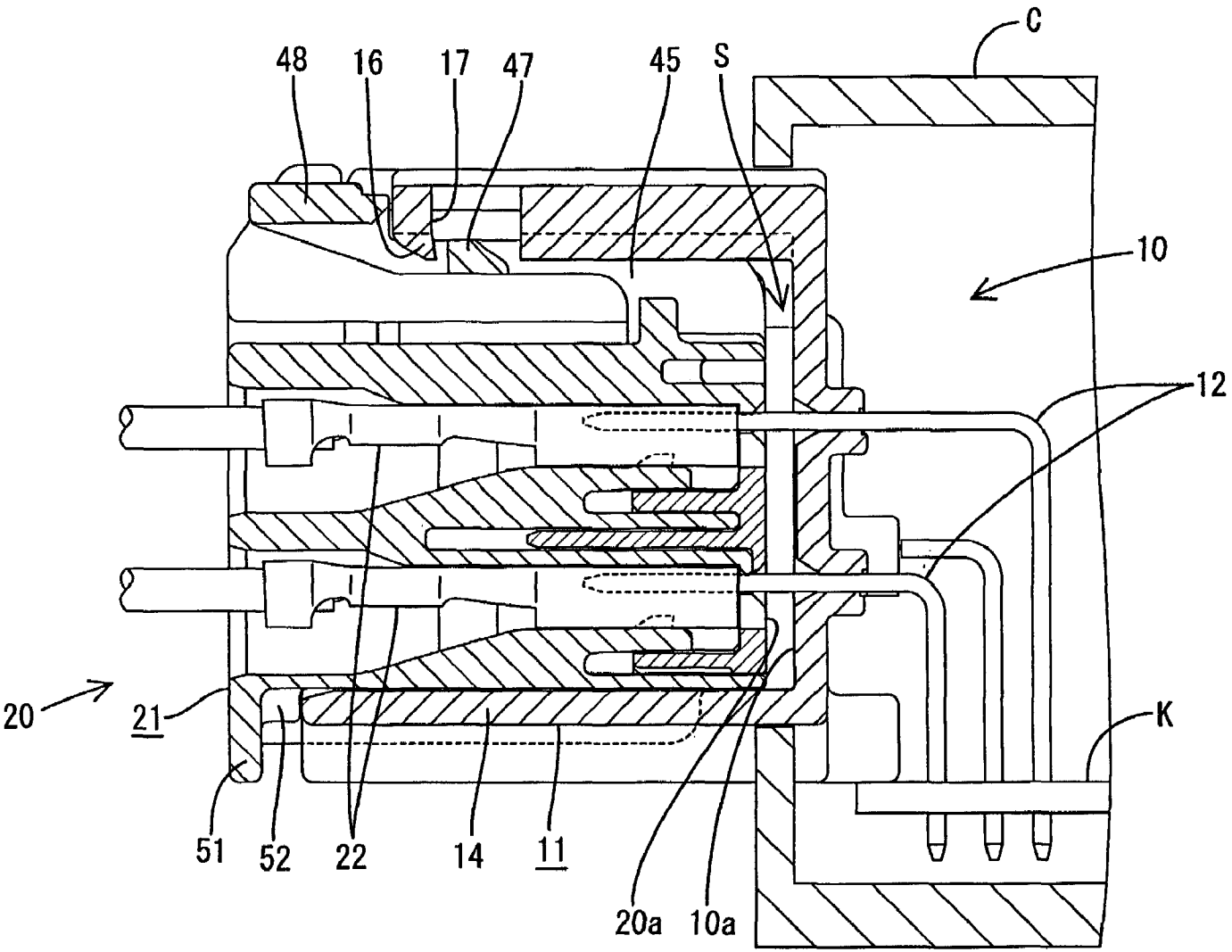
FIG. 22 is a cross-sectional view similar to FIG. 20, but showing the manufacturing dimensional variation.
Figure 23:
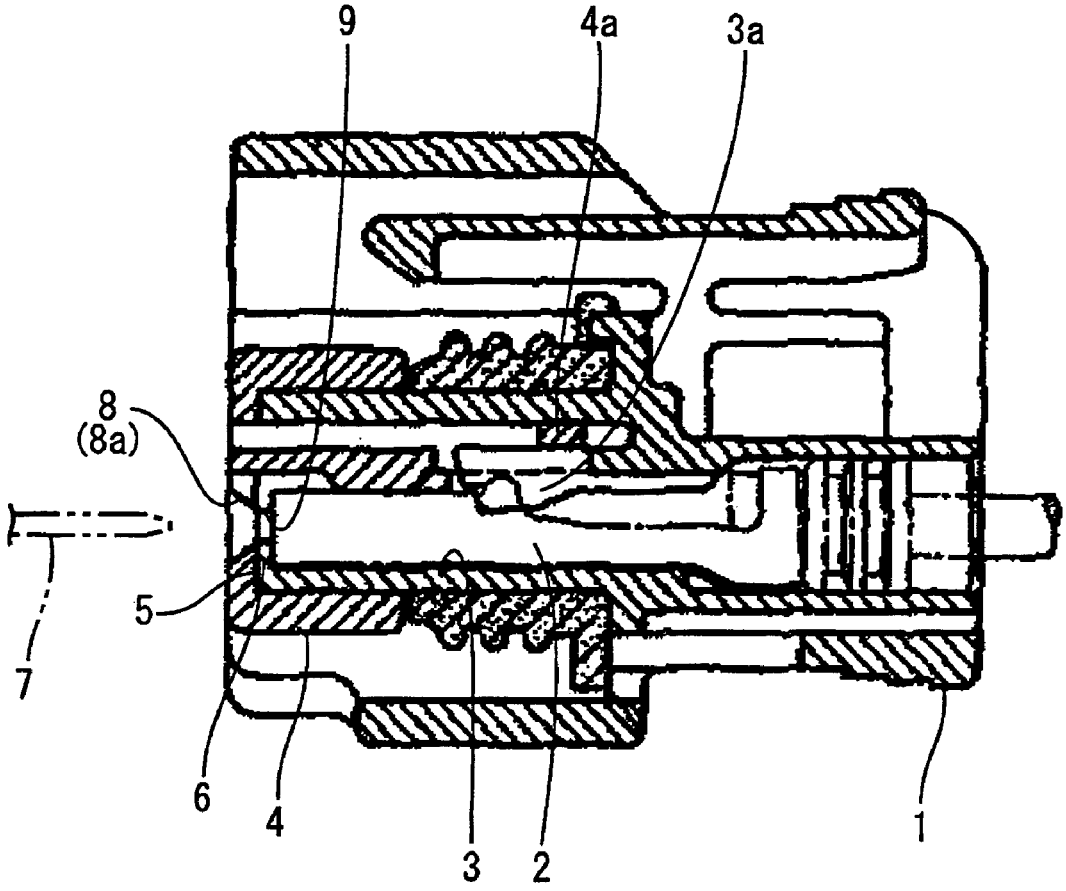
FIG. 23 is a cross-sectional view of a prior art connector.

A locking claw 16 projects in from approximately the widthwise center of the front end of the upper wall 15 of the hood 14, as shown in FIGS. 1 and 10. The front and rear surfaces of the locking claw 16 slope up from their rear ends toward their front ends. A locking means penetration space 17 is formed rearward from the locking claw 16. The locking means penetration space 17 is generally quadrilateral in the plan view show in FIG. 2 and opens up through the upper wall 15 of the hood 14 along a direction substantially orthogonal to the longitudinal direction of the male housing 11. Accordingly, the locking means penetration space 17 is formed with a molding die that has an upwardly-drawn core to shape the locking means penetration space 17 when a resin is molded into the male housing 11. The locking means penetration space 17 is not in a longitudinal penetration through the terminal fitting-holding part 13, as in the prior art of FIG. 22, but is a vertical penetration through the hood 14. Therefore it is possible to prevent water from penetrating into the casing C.

Figure 12:
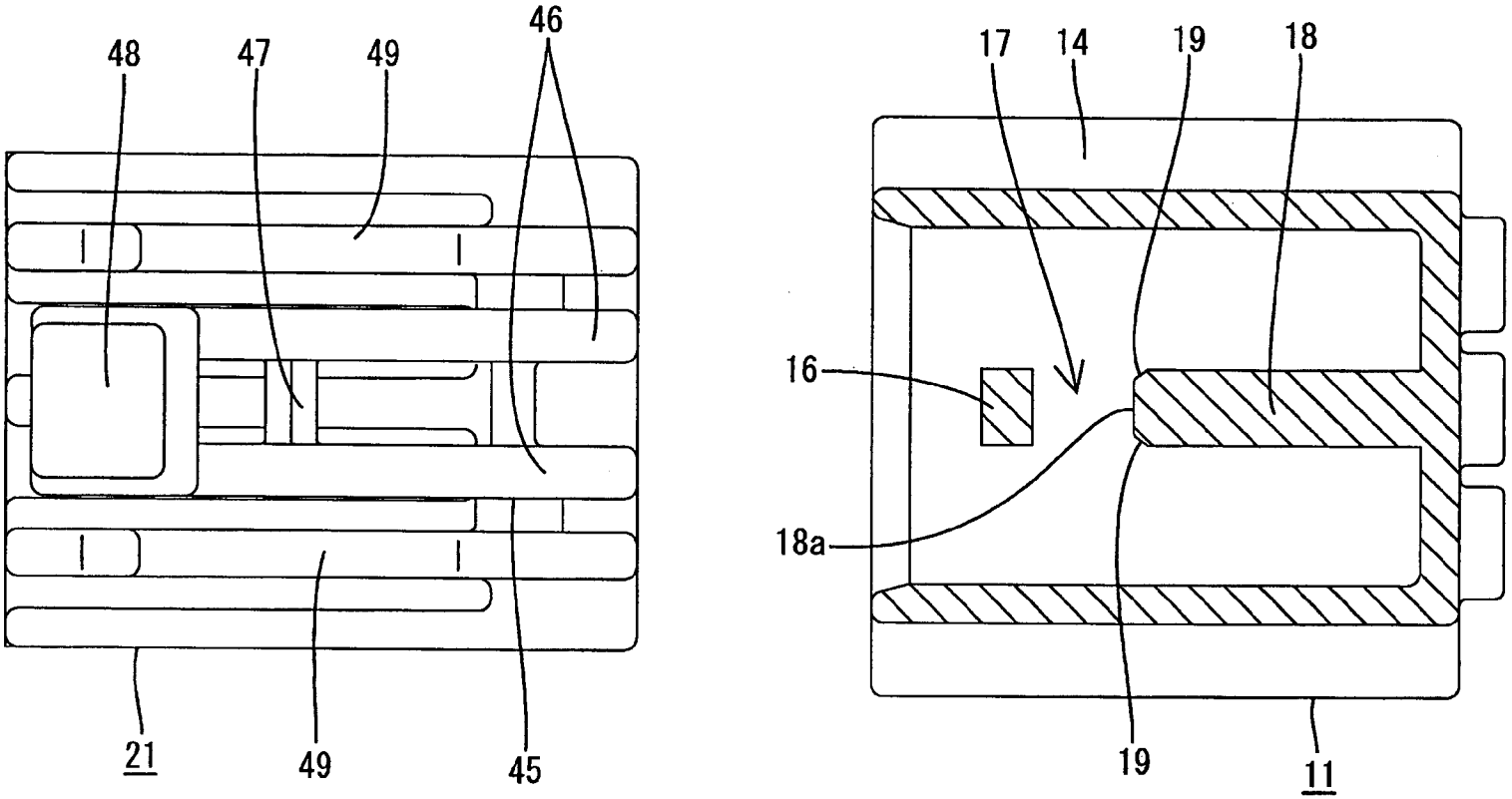
FIG. 12 is a sectional plan view of a state before both housings are fitted in each other.

As shown in FIGS. 10 and 12, a reinforcing rib 18 projects in from the upper wall 15 of the hood 14 and extends rearward from the locking means penetration space 17 along the longitudinal direction of the male housing 11. Thus, the front end 18*a* of the reinforcing rib 18 is substantially opposed to the locking claw 16 and the rear end of the reinforcing rib 18 is continuous with the front surface of the terminal fitting-holder 13. The width and the inwardly projection of the reinforcing rib 18 are almost equal to the corresponding dimensions of the locking claw 16. The reinforcing rib 18 is formed by a die that has a forwardly drawn core for shaping the side surfaces of the reinforcing rib 18 and an upwardly drawn core for shaping the front surface thereof. Thus, the reinforcing rib 18 is shaped partly by the die for shaping the locking means penetration space 17.

Figure 2:
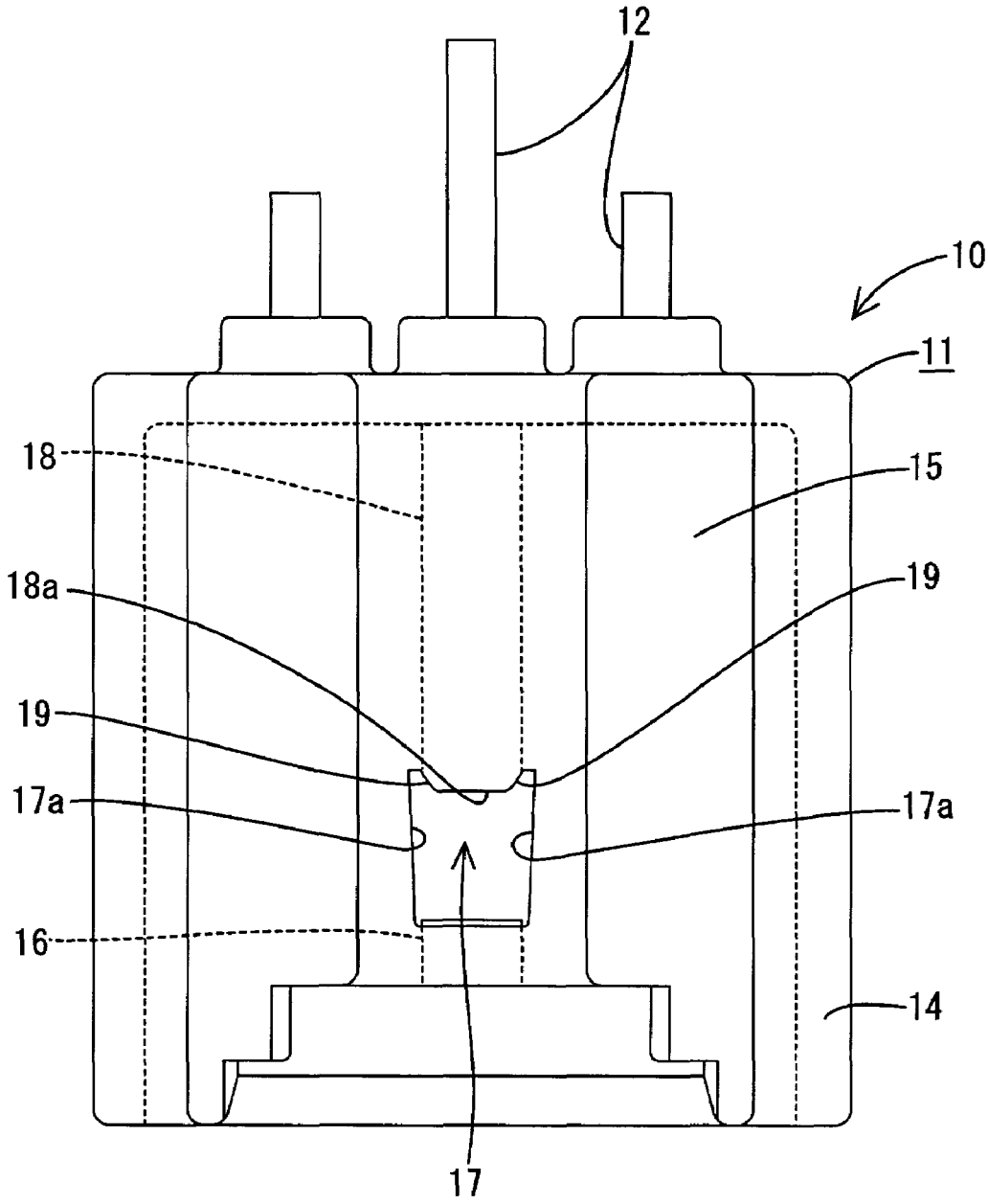
FIG. 2 is a plan view of the male housing.

As shown in FIGS. 2 and 12, tapered guides 19 are formed at both front widthwise corners of the front end 18*a* of the reinforcing rib 18. The tapered guides 19 help to guide the female connector 20 into the male housing 11. The locking means penetration space 17 becomes gradually wider toward its rear end. However, the side surfaces 17*a* of the locking means penetration space 17 are tapered more gently than the guides 19. The distance between the tapered side surface 17*a* of the locking means penetration space 17 and the guide 19 confronting the side surface 17*a* is wider than a distance would be between a longitudinally straight side surface 17*a* and the guide 19. Therefore, the core of the die that is drawn up between the side surface 17*a* of the locking means penetration space 17 and the guide surface 19 can be sufficiently thick and strong.

The female connector 20 has a substantially block-shaped housing 21 made of synthetic resin. Female terminal fittings 22 are accommodated in the female housing 21 and a front retainer 23 is mounted on the front of the female housing 21. The female housing 21 has six cavities 24 divided equally between upper and lower rows, and the female terminal fittings 22 can be inserted into the respective cavities 24 from the rear. A front wall 25 is formed at a front end of each cavity 24. A resiliently deformable lance 26 is cantilevered forwardly from a lower surface of each cavity 24 and is configured to lock the female terminal fitting 22. Each lance 26 can deform elastically into a flexible space 27 disposed below the lance 26. The female terminal fitting 22 has an approximately box-shaped body 22*a* and a barrel 22*b* to be connected to the end of an electric wire W. A locking hole (not shown) is formed on a lower surface of the body 22*a* and the lance 26 can be locked to the peripheral edge of the locking hole. The body 22*a* includes an elastic contact piece (not shown) for elastically contacting the male terminal fitting 12.

Figure 3:
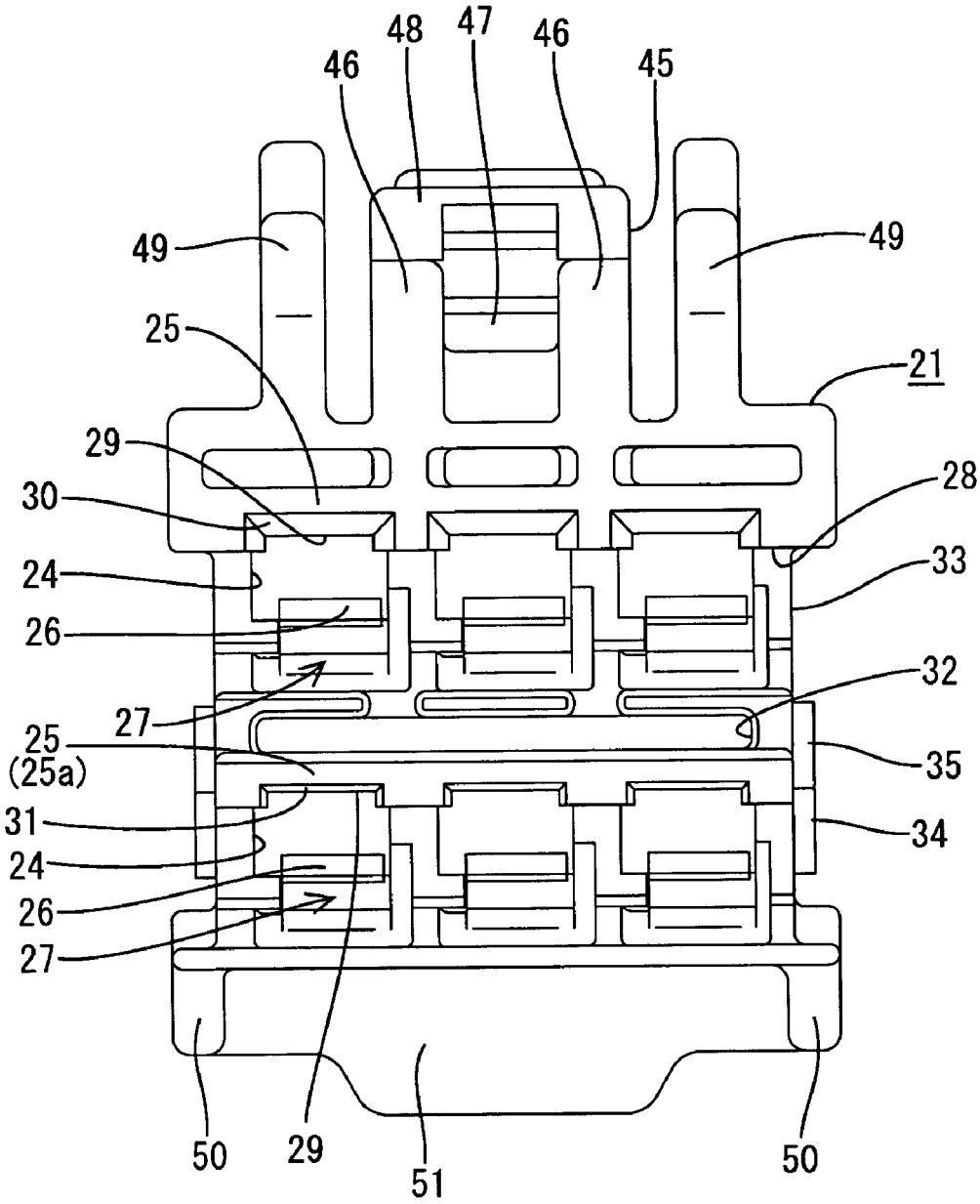
FIG. 3 is a front view of a female housing.
Figure 4:
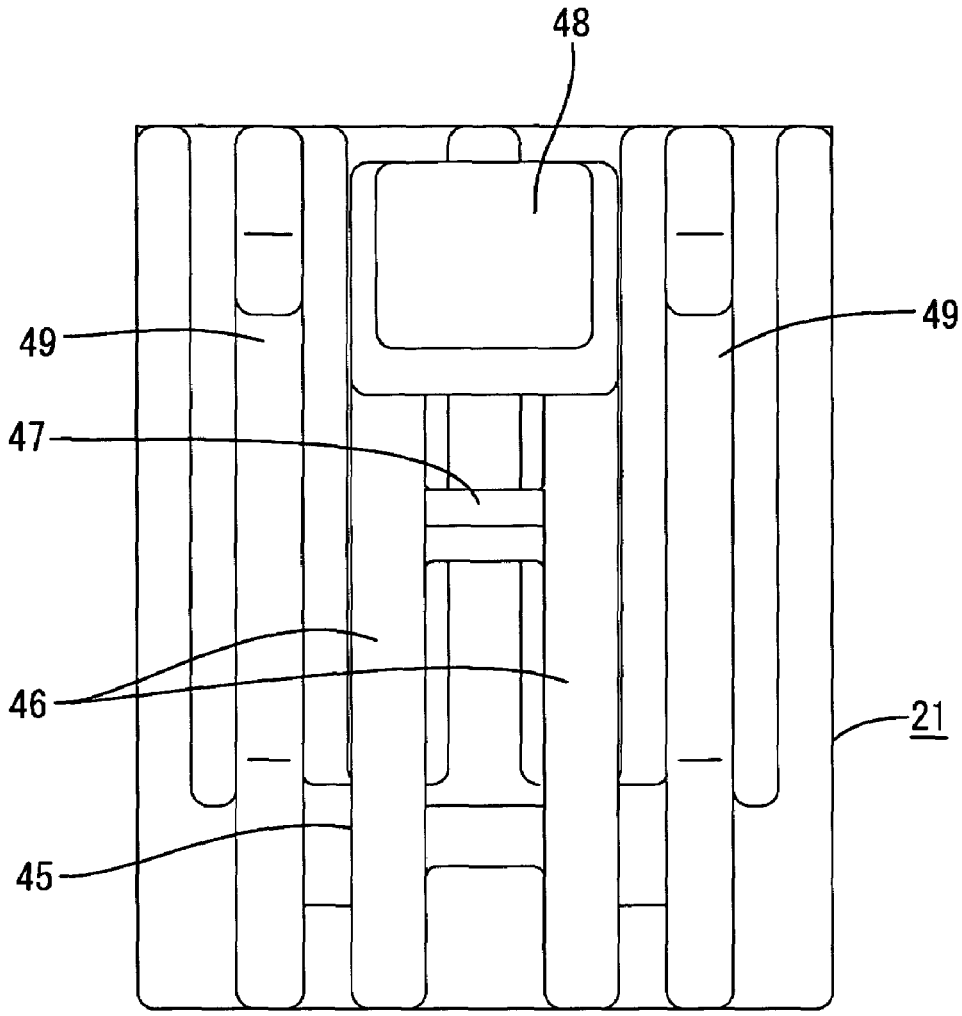
FIG. 4 is a plan view of the female housing.
Figure 7:
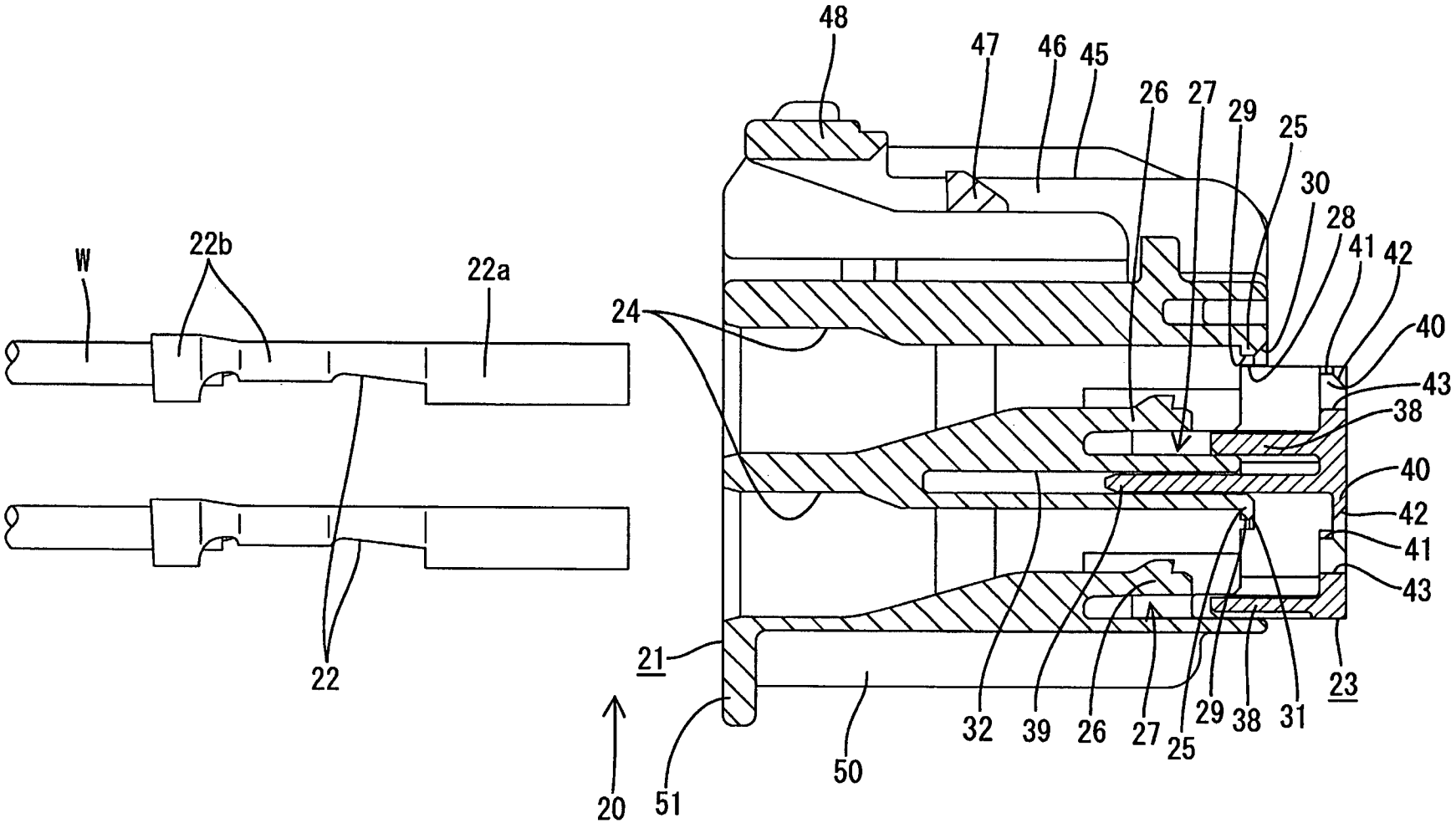
FIG. 7 is a sectional side elevation of a state before female terminal fittings are inserted into a female housing in which a front retainer is mounted on a temporary locking position.

As shown in FIGS. 3, 4, and 7, a locking arm 45 is provided at approximately the widthwise center of the upper surface of the female housing 21, and is configured for holding the male housing 11 and the female housing 21 in a fit-in state when the female housing 21 is fit in the male housing 11. The locking arm 45 has two substantially parallel cantilevered beams 46, a to-be-locked portion 47 connecting midway positions of the beams 46 to each other, and an operation portion 48 connecting rear ends of the beams 46 to each other. The spacing between the beams 46 is slightly greater the width of the locking claw 16 and the width of the reinforcing rib 18. Each beam 46 has a support at the front end of the female housing 21 and is elastically deformable about the support in a vertical direction intersecting the longitudinal direction in which the housings fit together. The locking claw 16 of the male connector 10 can be locked to the to-be-locked portion 47. A rear surface of the to-be-locked portion 47 is formed almost straight vertically. The front surface of the to-be-locked portion 47 slopes up from the front to the rear so that the front surface conforms to the slope of the front surface of the locking claw 16. The operation portion 48 can be pressed from above to deform the locking arm 45 elastically. Two protection walls 49 project on the upper surface of the female housing 21 at opposite respective sides of the locking arm 45. The protection walls 45 are higher than the locking arm 45. Two projected guide ribs 50 extend longitudinally at both widthwise ends of the lower surface of the female housing 21. A projected fingering portion 51 extends widthwise at the rear end of the lower surface of the female housing 21 and connects the guide ribs 50.

Figure 5:
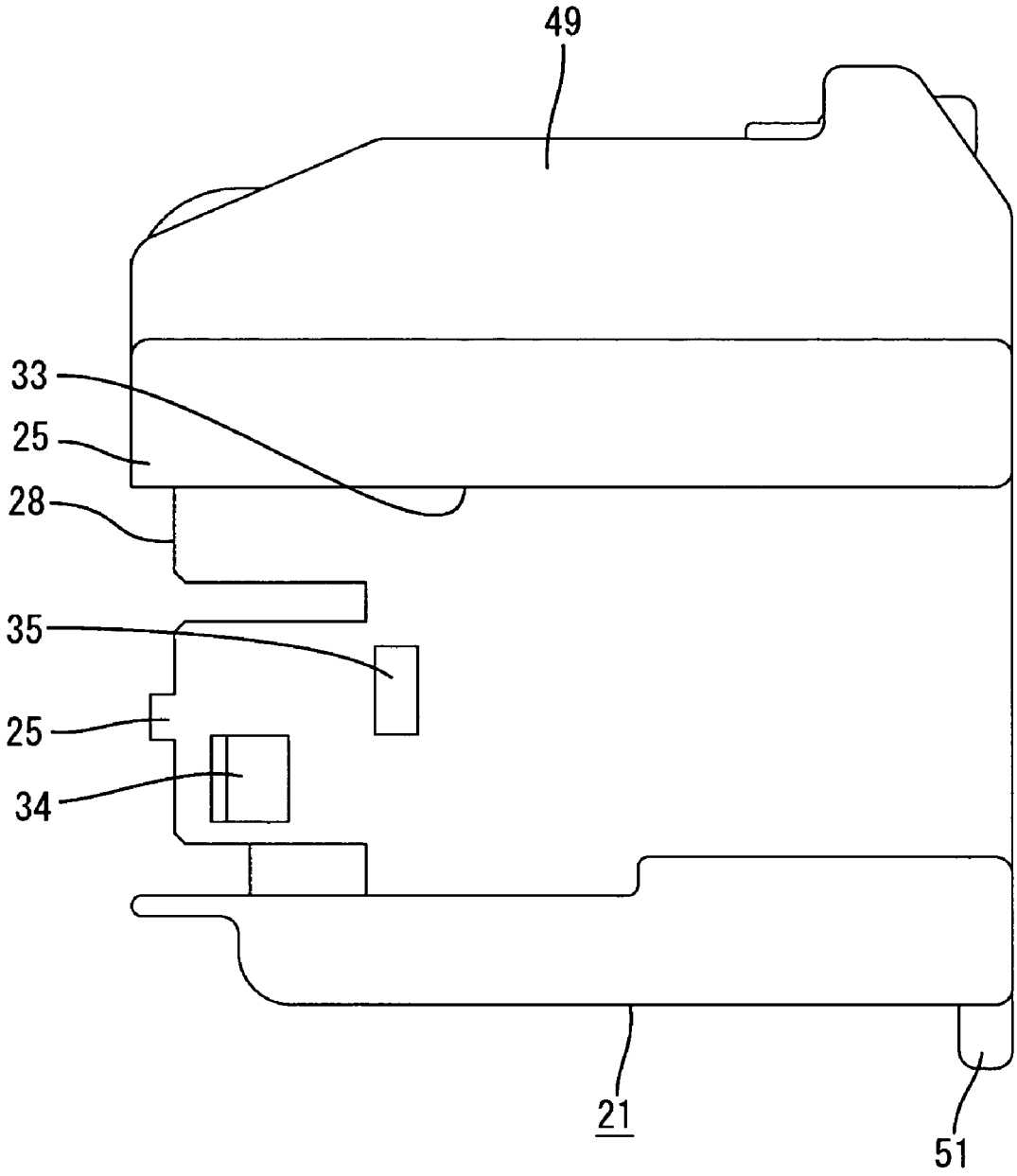
FIG. 5 is a side view of the female housing.

A front surface and both side surfaces of the female housing 21 are cut out to allow the front retainer 23 to be mounted on the female housing 21 from the front. More specifically, a cutout 28 is formed on the front surface of the female housing 21 and communicates with each cavity 24 and each flexible space 27. However, a part of the front wall 25 of each cavity 24 remains. In particular, the cutout 28 removes the lower half of the front wall 25 of each upper cavity 24 without removing the upper half of the front wall 25 thereof. The cutout also removes the lower half of the front wall 25 of each lower cavity 24 and the front of the upper half of the front wall 25 of each lower cavity 24. However, the rear of the upper half of the front wall 25 of each lower cavity 24 remains. The removed portions are disposed at the side of the front retainer 23. An insertion opening 29 is formed longitudinally through the remaining portion of each of the upper and lower front walls 25 for receiving the male terminal fitting 12. A tapered guide surface 30 is formed peripherally at the front end of the upper insertion opening 29 for guiding the insertion of the male terminal fitting 12. The cutout 28 includes a concave guide 32 between the upper and lower cavities 24. As shown in FIGS. 3 and 5, concavities 33 are formed on the side surfaces of the female housing 21. Each concavity 33 includes a projection 34 for holding the front retainer 23 at a temporary locking position, and a projection 35 for holding the front retainer 23 at a main locking position. The projections 34 and 35 are shifted from each other longitudinally and vertically.

Figure 6:
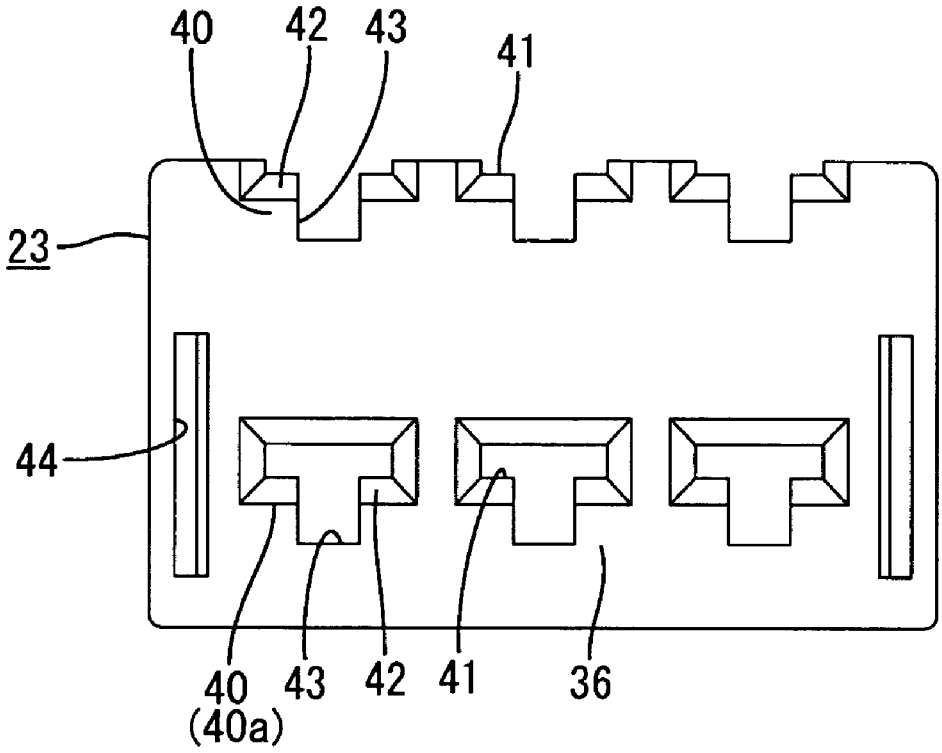
FIG. 6 is a front view of a front retainer.

The front retainer 23 is made of synthetic resin. As shown in FIGS. 6 and 7, the front retainer 23 has a front plate 36 and vertically tall side plates 37 extend rearward from the widthwise ends of the front plate 36. Two longitudinally long deformation prevention portions 38 extended rearward from a rear surface of the front plate 36, and a longitudinally long guide plate 39 extends rearward from a position on the rear surface of the front plate 36 between the deformation prevention portions 38. The front plate 36 is configured to fit in the cutout 28 of the female housing 21 and has a front wall 40 for each cavity 24 that is capable of matching the front wall 25 of the female housing 21. More specifically, the front wall 40 includes the lower half of the front wall 40 of each upper cavity 24 of the female housing 21, the lower half of the front wall 40 of each lower cavity 24, and the front portion 40*a* of the upper half of the front wall 40 of each lower cavity 24. On the front wall 40, an insertion opening 41 open forward is formed at a position where the insertion opening 41 is capable of matching the insertion opening 29 of the female housing 21. A tapered guide surface 42 is formed at the front end of each insertion opening 41 for guiding the insertion of the male terminal fitting 12 therein. The upper guide surface 42 matches the corresponding guide surface 30 at the side of the female housing 21. A jig insertion opening 43 is formed in a lower portion of the peripheral edge of each insertion opening 41 and communicates with the insertion opening 41. A jig (not shown) can be inserted into the jig insertion opening 43 from the front for unlocking the lance 26.

The side plates 37 can be inserted into the concavities 33 on the side surfaces of the female housing 21 so that the outer surfaces of the side plate 37 are substantially flush with the outer side surfaces of the female housing 21. A locking groove 44 is formed on the inner surface of the side plate 37 opposed to the female housing 21. The rear end of the locking groove 44 can be locked to the projection 34 for holding the front retainer 23 at the temporary locking position or the projection 35 for holding the front retainer 23 at the main locking position. Thus, the front retainer 23 can be held selectively at the temporary locking position (see FIG. 8) and the main locking position (see FIG. 11).

Figure 9:
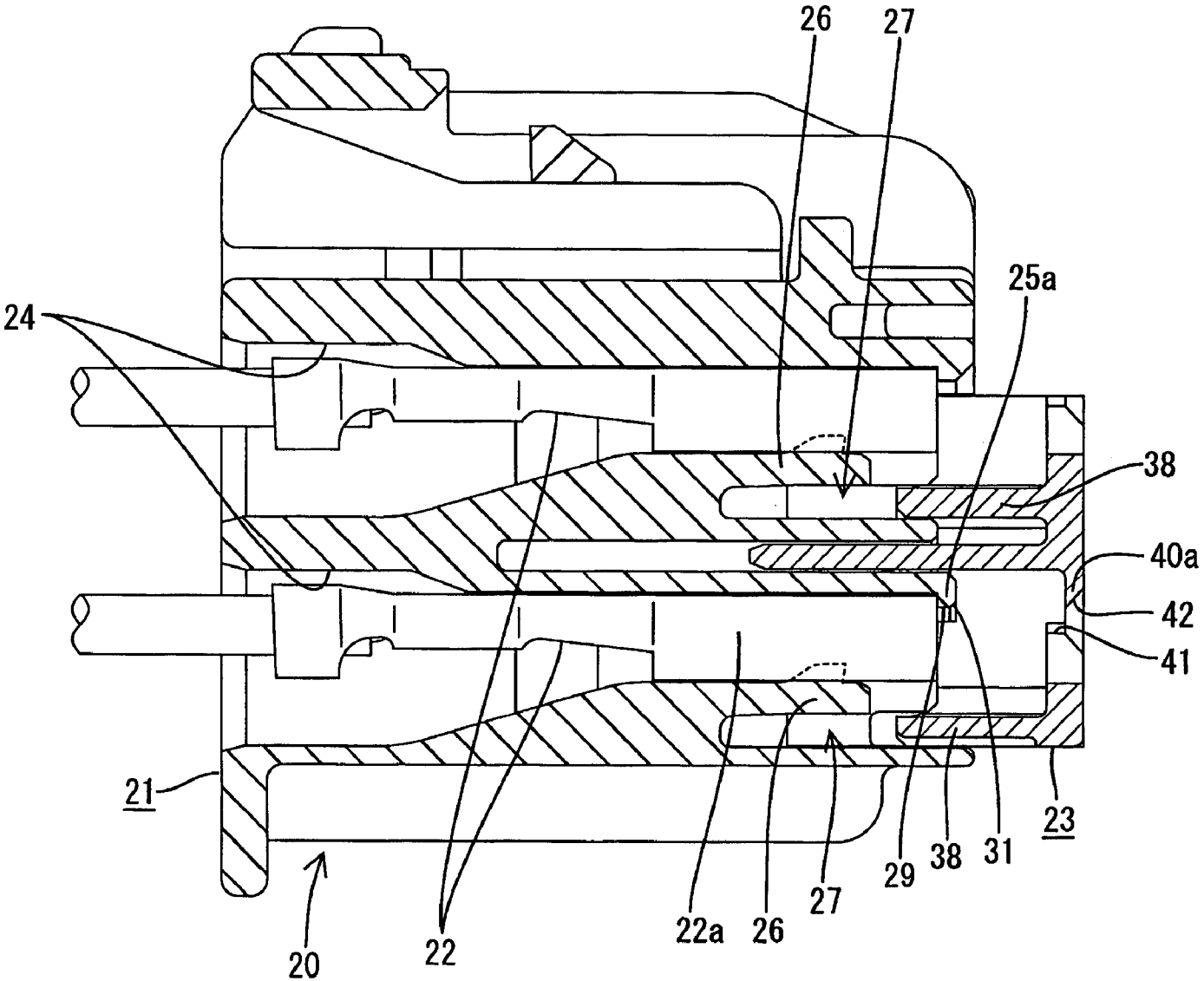
FIG. 9 is a sectional side elevation of a state after the female terminal fittings are inserted into the female housing in which the front retainer is mounted on the temporary locking position.

The deformation prevention portions 38 are at positions corresponding respectively to the upper and lower flexible spaces 27 of the female housing 21. The widthwise ends of each deformation prevention portions 38 are connected to inner surfaces of the side plates 37 to reinforce the elastic deformation prevention portions 38. As shown in FIGS. 7 and 9, the elastic deformation prevention portion 38 is forward of the flexible space 27 when the front retainer 23 is at the temporary locking position in the female housing 21. Thus, the lances 26 can deform and the female terminal fittings 22 can be inserted into or removed from the respective cavities 24. On the other hand, the deformation prevention portions 38 advance into the flexible spaces 27 when the front retainer 23 is mounted at the main locking position, as shown in FIG. 10. Thus, the lances 26 cannot deform. The front wall 25 of the female housing 21 and the front wall 40 of the front retainer 23 match each other in the longitudinal direction when the front retainer 23 is at the main locking position. Additionally, the front surface of the front retainer 23 is substantially flush with the front surface of the female housing 21 when the front retainer 23 is at the main locking position. The front surface of the front retainer 23 and the front surface of the female housing 21 fit on the front surface of the terminal fitting-holder 13. The guide plate 39 guides the longitudinal movement of the front retainer 23 when the guide plate 39 is inserted into the guide concavity 32 of the female housing 21.

As described above, the upper half of the front walls 25, 40 for the lower cavity 24 of the male connector 20 is divided longitudinally into the front portion 40*a* at the side of the front retainer 23 and the rear portion 25*a* at the side of the female housing 21 for the insertion openings 29 and 40. When the front retainer 23 is mounted properly at the main locking position, as shown in FIG. 10, the rear portion 25*a* and the front portion 40*a* are disposed longitudinally without a gap therebetween, and the insertion openings 29 and 41 align. A tapered auxiliary guide surface 31 is formed at the front periphery of the insertion opening 29 of the rear portion 25*a* of the female housing 21. Thus, the distal end of the male terminal fitting 12 slidably contacts the auxiliary guide surface 31 when the male terminal fitting 12 has passed the insertion opening 41 in the front portion 40*a* at the side of the front retainer 23 and advances into the insertion opening 29 in the rear portion 25*a* at the side of the female housing 21. Therefore, the insertion operation for the male terminal fitting 12 is guided. A maximum dimensional error in the tolerance range could occur between the resin female housing 21 and the resin front retainer 23 (see the imaginary line in FIGS. 10 and 15). However, the front end of the auxiliary guide surface 31 and the rear end of the guide surface 42 of the front retainer 23 are radially coincident with each other. That is, the auxiliary guide surface 31 is formed in a range in which it is capable of displaying the guide function.

Figure 8:
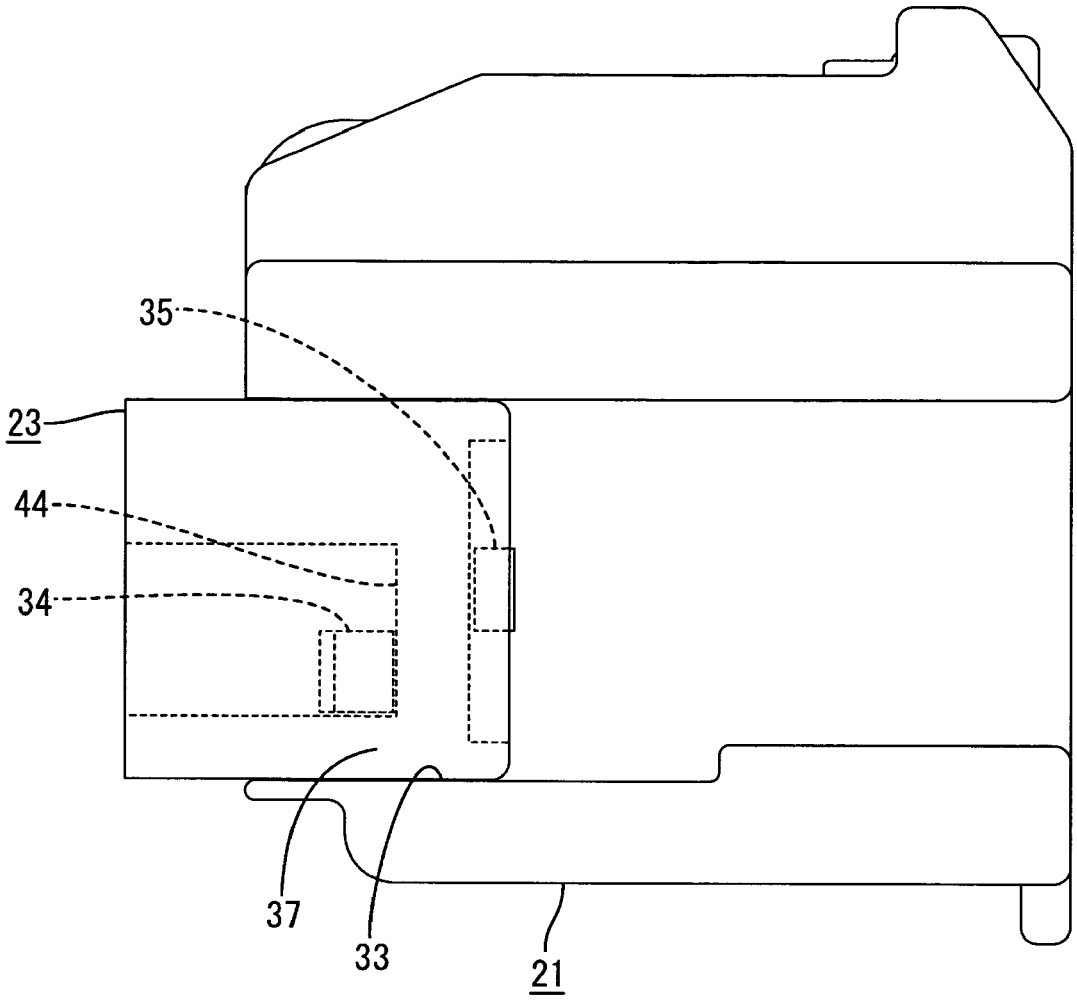
FIG. 8 is a side view of the female housing in which the front retainer is mounted on the temporary locking position.
Figure 11:
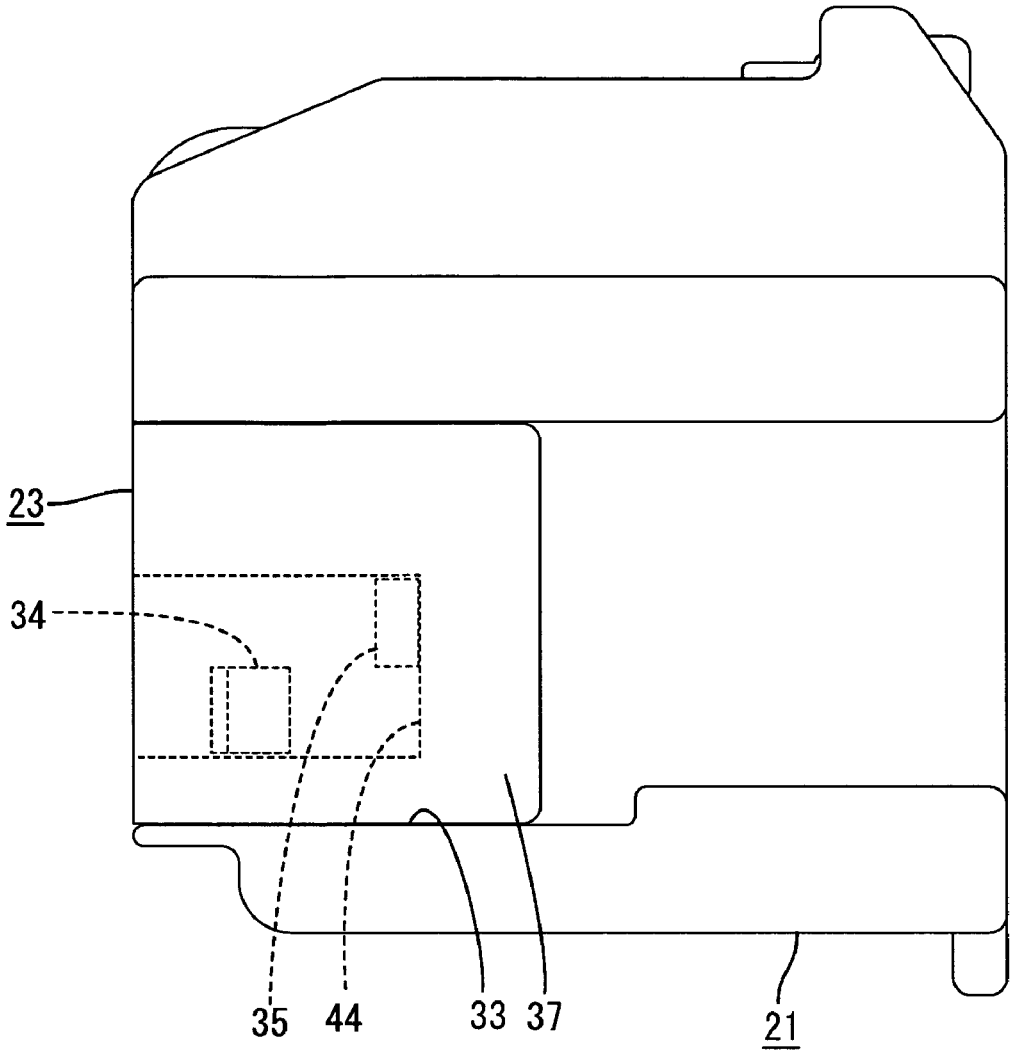
FIG. 11 is a side view of the female housing in which the front retainer is mounted on the main locking position.

The female connector 20 is assembled by mounting the front retainer 23 at the temporary locking position on the female housing 21. The female terminal fittings 22 then are into the respective cavities 24 from the rear, as shown in FIGS. 7 and 8, and press the lances 26. Thus, the lances 26 deform elastically into the flexible space 27. The lances 26 restore resiliently when the respective female terminal fittings 22 reach the proper depth in the cavities 24, as shown in FIG. 9. Thus, the lances 26 engage the edge of the respective locking holes to prevent removal of the female terminal fittings 22 from the cavities 24. At this time, the front end of the female terminal fitting 22 contacts the front wall 25 of the female housing 21 to stop each female terminal fitting 22 at the predetermined position. The front retainer 23 then is pressed to the main locking position, as shown in FIGS. 10 and 11. As a result, the deformation prevention portions 38 advance into the flexible spaces 27 to prevent deformation of the lances 26 and to hold the female terminal fittings 22 in the cavities 24 with a strong force. When the front retainer 23 reaches the main locking position, the front plate 36 of the front retainer 23 fits in the cutout 28 of the female housing 21, and the front wall 40 and the insertion opening 41 at the side of the front retainer 23 match the front wall 25 and the insertion opening 29 at the side of the female housing 21 respectively.

Figure 13:
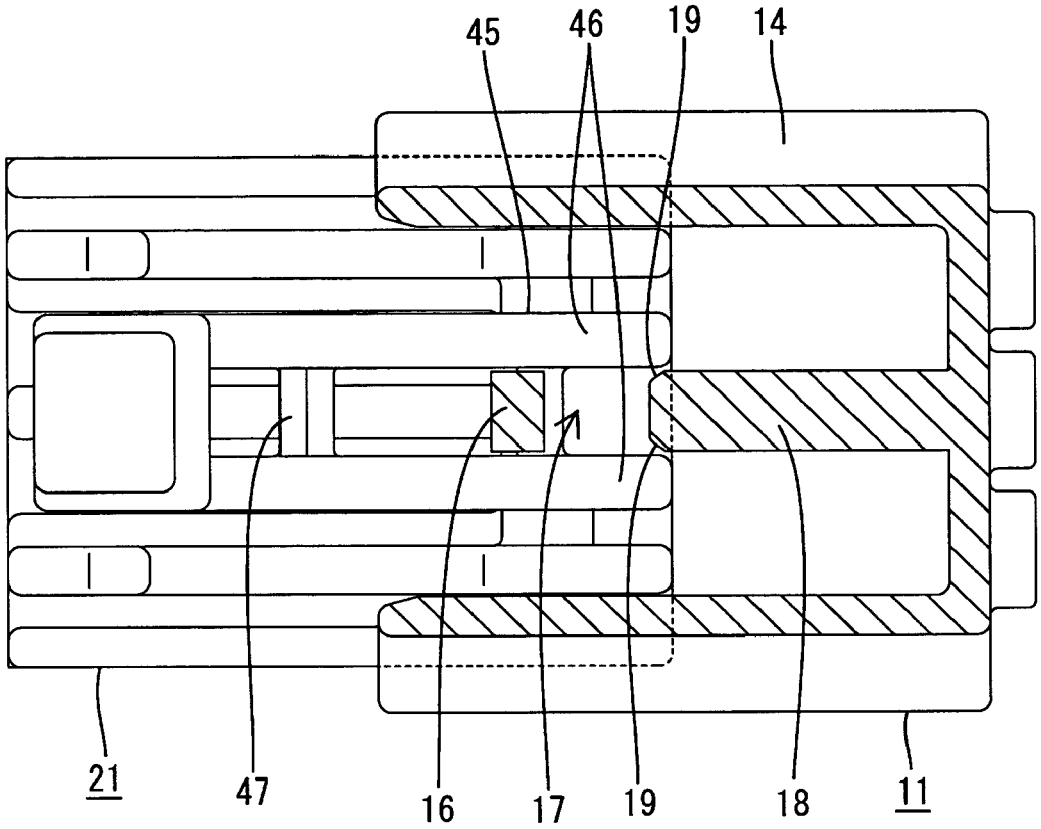
FIG. 13 is a sectional plan view of a state in which both housings are being fitted in each other.
Figure 14:
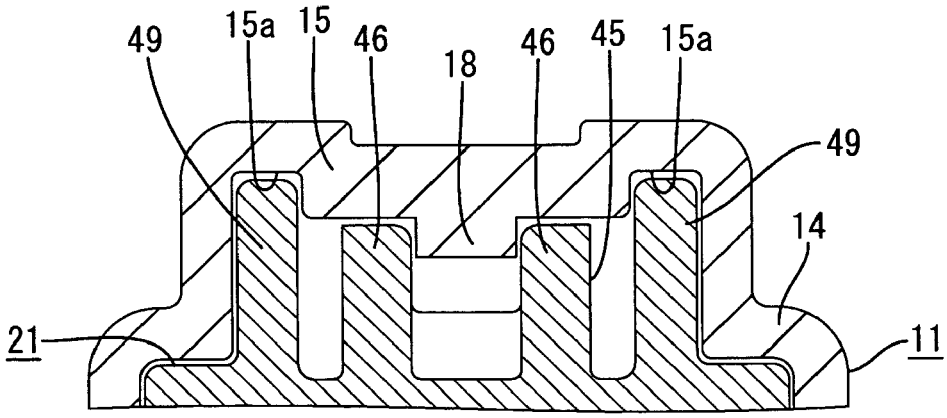
FIG. 14 is a partially sectional front view showing the relationship between a reinforcing rib and a locking arm, while both housings are being fitted in each other.

The assembled male connector 10 is mounted on the substrate K and the casing C, as shown in FIG. 10. The female connector 20 then is fit in the portion of the male connector 10 outside of the casing C. The guide ribs 50 advance into the guide grooves 14*a* and the protection walls 49 advance into the receiving grooves 15*a* to guide the female housing 21 into the hood 14. In this process, the locking claw 16 and the reinforcing rib 18 advance into the space between the beams 46, as shown in FIGS. 13 and 14. At this time, the guide surfaces 19 at the widthwise ends of the front surface 18*a* of the reinforcing rib 18 slidably contact the inner surfaces of the beam 46. Thus the female housing 21 is fit smoothly into the male connector 10 without catching the reinforcing rib 18. The front surface of the locking claw 16 slidably contacts the front surface of the to-be-locked portion 47 and presses the to-be-locked portion 47 down as the connection of the male and female connectors 10 and 20 progresses. Thus, the locking arm 45 deforms elastically down.

Figure 15:
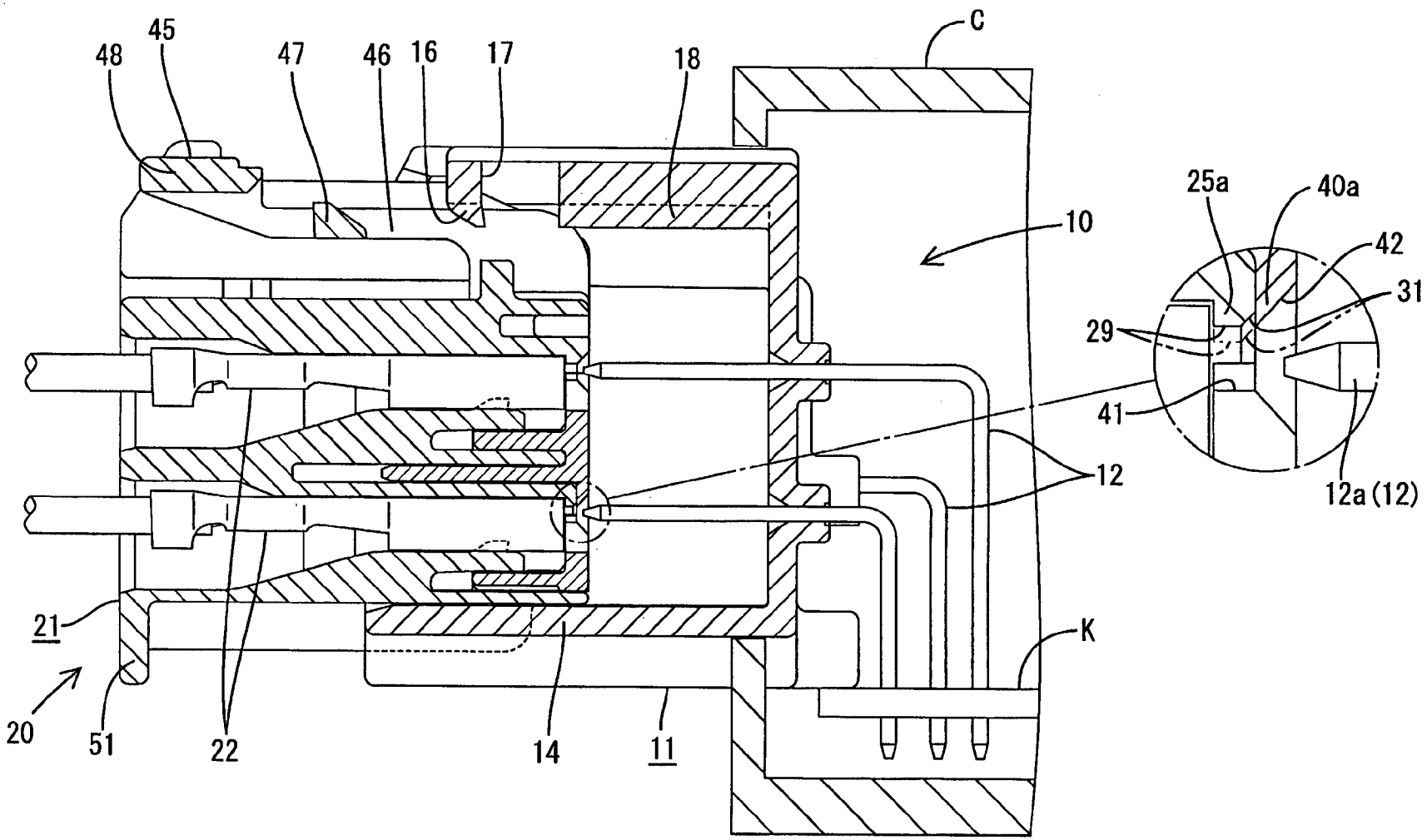
FIG. 15 is a sectional side elevation of a state while both housings are being fitted in each other.
Figure 16:
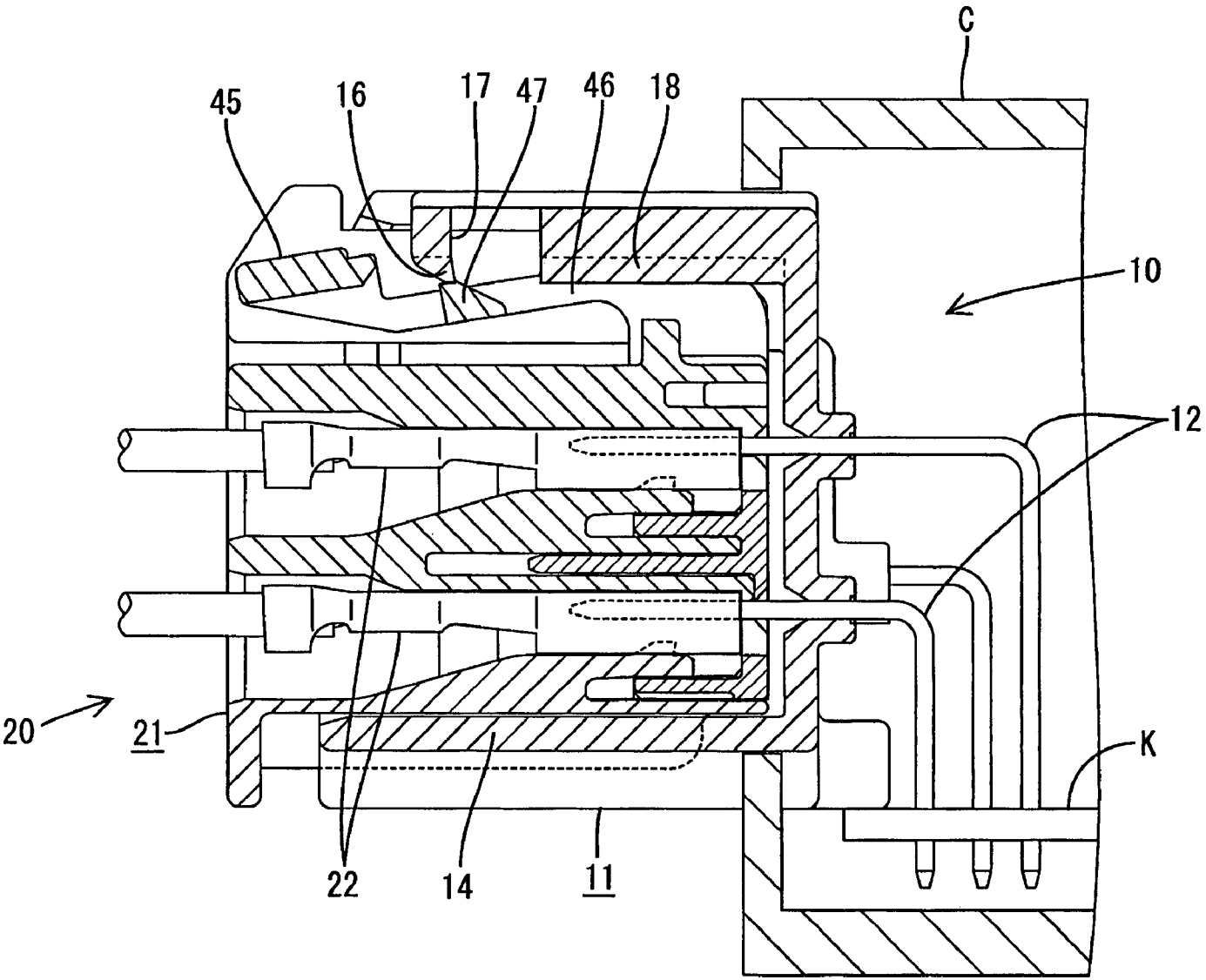
FIG. 16 is a sectional side elevation of a state in which both housings are approaching their predetermined normal depth.

The male terminal fittings 12 are inserted into the insertion openings 29, 41 when the fitting between the male and female connectors 10 and 20 progresses to the predetermined depth, as shown in FIG. 15. The distal end of the male terminal fitting 12 can slidably contact the guide surfaces 30, 42 at an initial stage of the insertion operation. The fitting surface of the female housing 21 inclines at an angle while the female housing 21 is fit into the male housing 11. Therefore, the male terminal fitting 12 can be inserted smoothly into the insertion openings 29, 41 even if the male terminal fitting 12 is not coaxial with the insertion openings 29, 41. The upper half of part of the front walls 25, 40 at the lower stage is divided longitudinally into the front portion 40*a* at the side of the front retainer 23 and the rear portion 25*a* at the side of the female housing 21. Therefore there is a fear that the peripheral portion of the insertion opening 29 will catch the male terminal fitting 12 when the male terminal fitting 12 advances from the insertion opening 41 in the front retainer 23 to the insertion opening 29 in the female housing 21. However, the auxiliary guide surface 31 is at the front end of the insertion opening 29 of the rear portion 25*a* of the female housing 21. Therefore the distal end of the male terminal fitting 12 slidably contacts the auxiliary guide surfaces 3 and the male terminal fitting 12 is inserted smoothly into the insertion opening 29 without being caught by the peripheral portion of the insertion opening 29 of the female housing 21.

Figure 17:
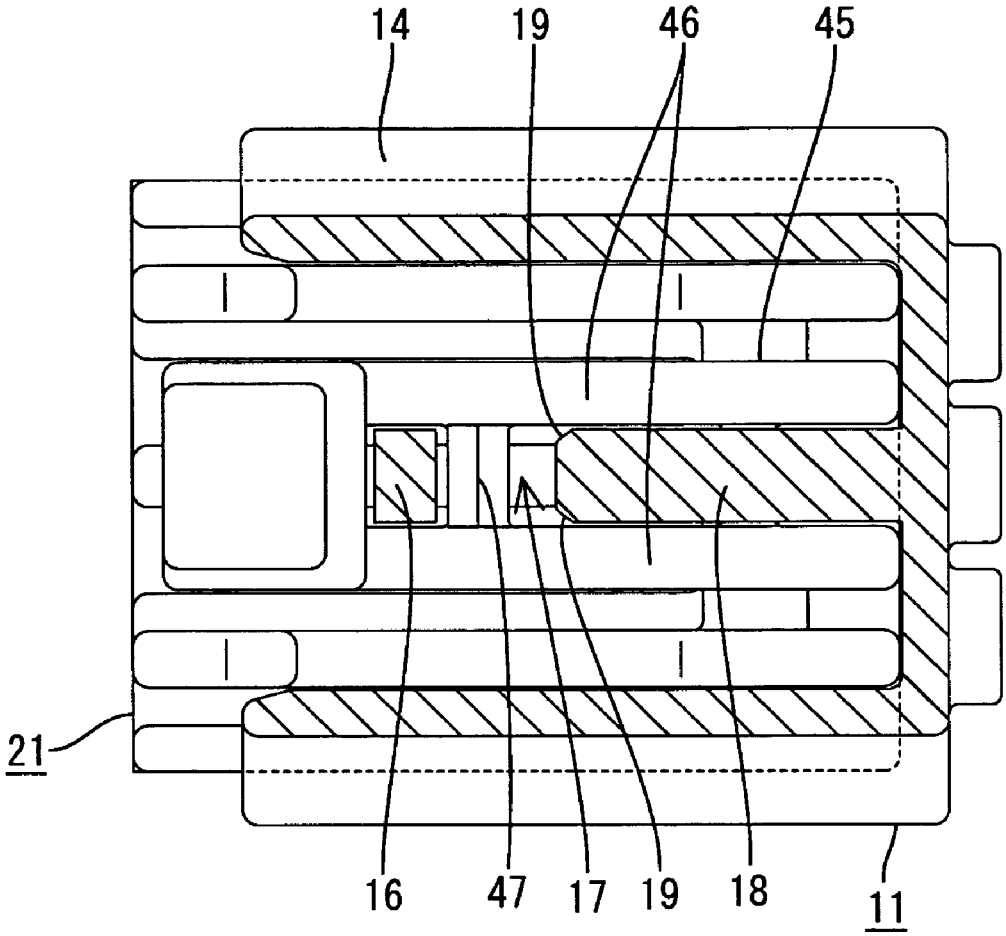
FIG. 17 is a sectional plan elevation of the state in which both housings have been fitted in each other in the predetermined normal depth.
Figure 18:
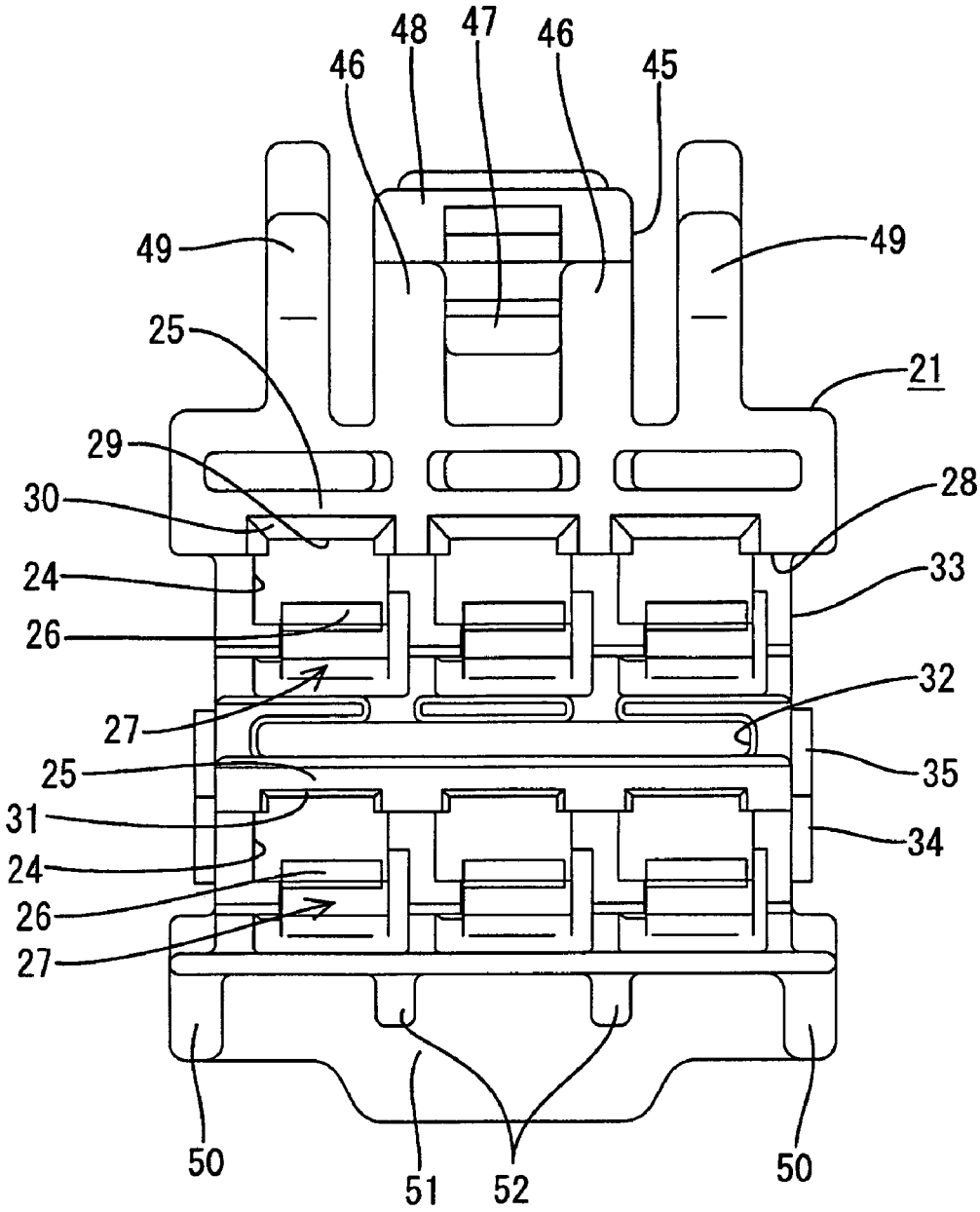
FIG. 18 is a front view of a female housing according to a second embodiment of the present invention.

The locking arm 45 returns to its original state when the female housing 21 and the male housing 11 are fit together to the predetermined normal depth shown in FIG. 17. Therefore the to-be-locked portion 47 advances into the locking means penetration space 17, and the rear surface of the locking means penetration space 17 is locked to the rear surface of the locking claw 16 to hold the housings 11, 21 together. The fit-in surfaces of both connectors 10 and 20 normally contact each other when the female housing 21 is fit in the male housing 11 to the predetermined normal depth. Additionally, the front surface of the stop 52 strikes the front surface of the hood 14 when the female housing 21 has advanced into the hood 14 to the predetermined normal depth to ensure that the female housing 21 does not advance too far into the hood 14. Thus, the male and female terminal fittings 12 and 22 are assured of being connected properly. The front surface 18*a* of the reinforcing rib 18 is opposed to the front surface of the to-be-locked portion 47 when the entire reinforcing rib 18 is in the space between the beams 46. In the normal fit-in state, the fingering portion 51 and the front surface of the hood 14 are spaced so that an operator can grasp the fingering portion 51 easily to separate the housings 11, 21.

As described above, the upper half of the front walls 25, 40 is divided longitudinally into the front portion 40*a* at the side of the front retainer 23 and the rear portion 25*a* at the side of the female housing 21 for the insertion openings 29 and 40. When the front retainer 23 is mounted properly at the main locking position, as shown in FIG. 10, the rear portion 25*a* and the front portion 40*a* are disposed longitudinally without a gap therebetween, and the insertion openings 29 and 41 align with each other. In this construction, the auxiliary guide surface 31 is at the front end of the insertion opening 29 of the rear portion 25*a* at the side of the female housing 21. Thus when the male terminal fitting 12 advances into the insertion opening 29 at the side of the female housing 21 from the insertion opening 41 at the side of the front retainer 23, the male terminal fitting 12 can be inserted smoothly without the terminal fitting 12 being caught by the periphery of the insertion opening 29.

FIGS. 18 through 22 show a variation of the embodiment shown in FIGS. 1 through 17. The embodiment of FIGS. 18 through 22 is virtually the same as the embodiment of FIGS. 1 through 17, and the same numbers are used for the identical parts. However, the embodiment of FIGS. 18 through 22 has two stops 52 that project down and out from the lower part of the female housing 21, which is the wall of the female housing 21 opposite the wall that has the locking arm 45. The stops 52 are spaced apart in the width direction of the female housing 21. The rear end of each stop 52 is connected to the fingering portion 51, while the front surface of each stop 52 is vertically straight. The longitudinal lengths of the stops 52 are set so that the front surface of the stops 52 strike a front surface of a lower portion of the hood 14 when the female housing 21 has advanced to the predetermined normal depth into the hood 14. Thereby it is possible to prevent the female housing 21 from being pressed into the hood part 14 beyond the predetermined normal depth.

Figure 19:
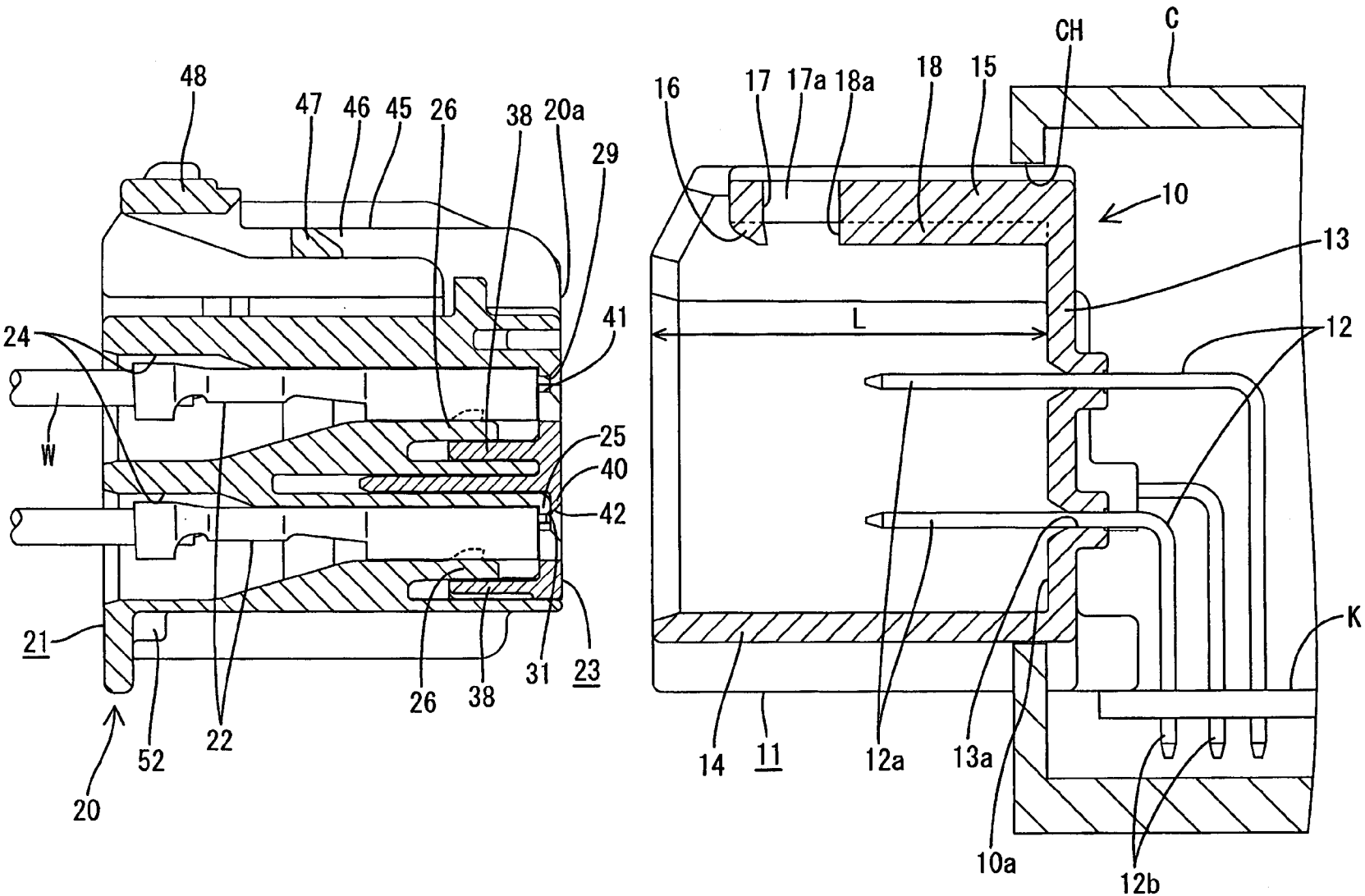
FIG. 19 is a cross-sectional view similar to FIG. 10, but showing the alternate embodiment.
Figure 20:
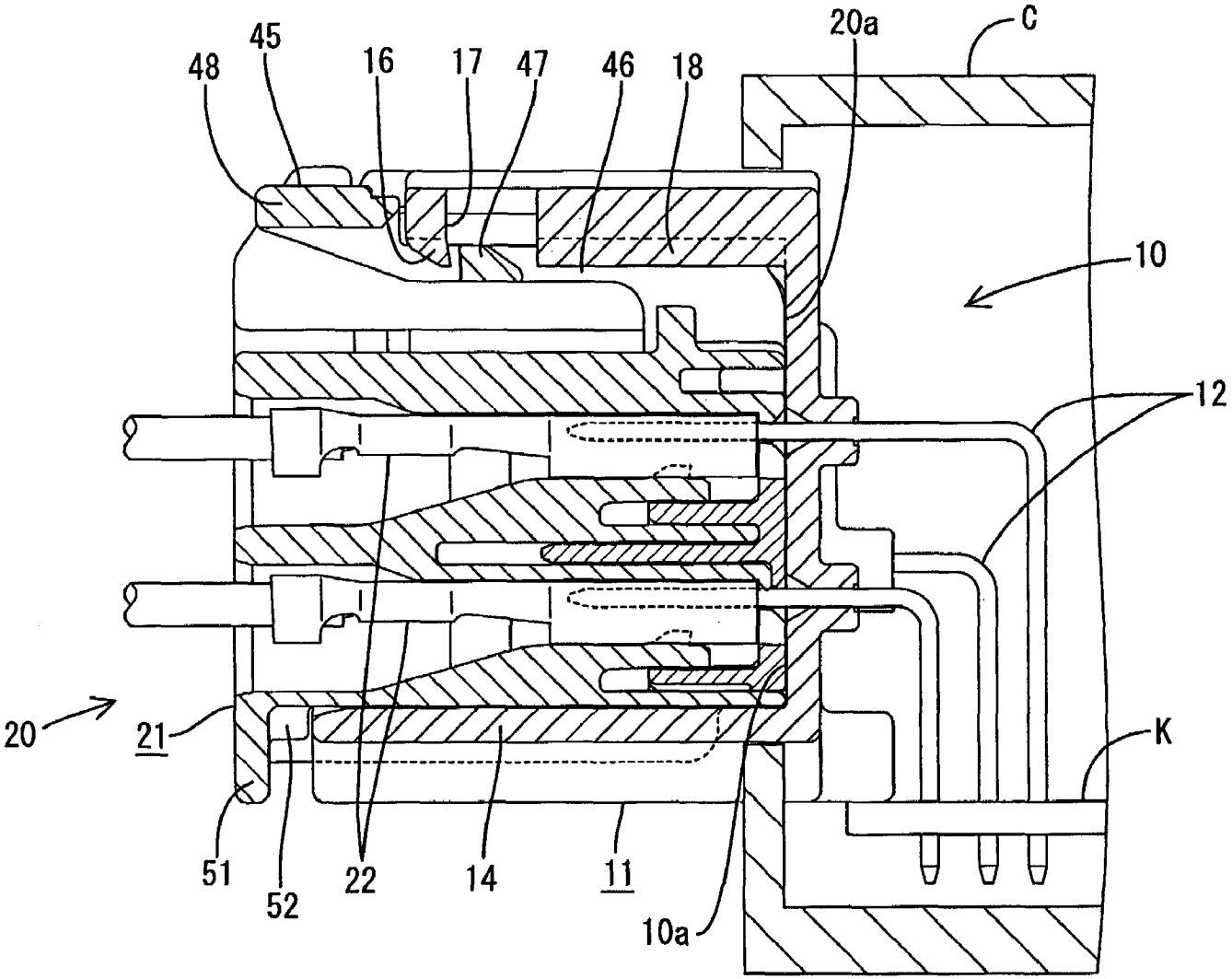
FIG. 20 is a cross-sectional view similar to FIG. 19, but showing the housings of the alternate embodiment at their predetermined normal depth.
Figure 21:
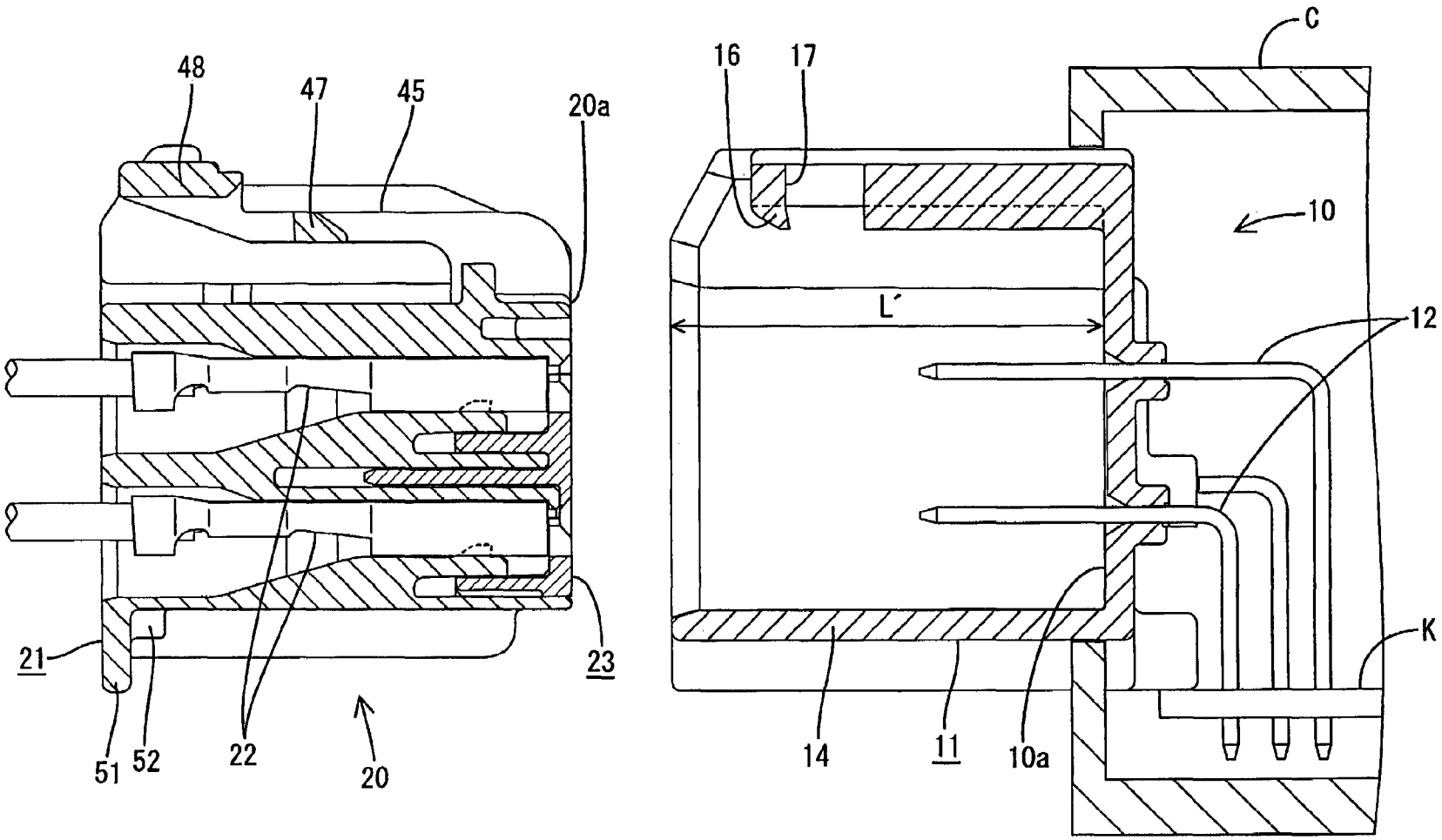
FIG. 21 is a cross-sectional view similar to FIG. 19, but showing a manufacturing dimensional variation.

As shown in FIG. 21, there is a possibility that the longitudinal dimension L' of the hood 14 exceeds the longitudinal dimension L (see FIG. 19) suitable for the female connector 20. This may occur, for example, when one manufacturer makes the male connector 10 and another manufacturer makes the female connector 20. In this case, the fit-in surface 10*a* of the male connector 10 and the fit-in surface 20*a* of the female connector 20 do not contact each other and are spaced by a gap S when the female connector 20 is fitted in the hood 14 to the predetermined normal depth, as shown in FIG. 19. Thus there is a fear that the female housing 20 will be pressed forward beyond the predetermined normal depth and that the connection of the terminal fittings 12, 22 will be affected adversely. For example, over-insertion can permanently deform one or both terminal fittings 12, 22. The operation portion 48 for unlocking the locking arm 45 projects from the rear end of the locking arm 45 and can be made to strike against the hood 14. However, the locking arm 45 is required to be elastically deformable. Consequently further progress of the fit-in operation can occur. Thus, in this case, it is difficult to restrict the fit-in depth of the housings 10, 20 to the predetermined normal fit-in depth.

However, the front surfaces of the stops 52 on the female housing 21 strike the front surface of the lower portion of the hood 14 when the female housing 21 is pressed into the hood 14 to the predetermined normal depth. Thus further progress of the fit-in operation is prevented. The stop 52 is not on a portion of the female housing 21 that is elastically deformable. Thus, it is possible to prevent the female connector 20 from advancing excessively into the hood 14 and the terminal fittings 12 and 22 will not be deformed by over-insertion.

The invention is not limited to the embodiment described above with reference to the drawings. For example, the following embodiments are included in the technical scope of the invention. Further, various modifications of the embodiments can be made without departing from the scope of the invention.

The front wall of the lower cavity is divided into a portion at the side of the front retainer and a portion at the side of the housing. However, the front wall of the upper cavity may have the same construction as the front wall of the lower cavity.

It is necessary to divide at least one part of the front wall into front and rear portions, and in the above-described embodiment, only the upper half of the front wall is divided into front and rear portions. However, the lower half of the front wall could be divided into front and rear portions or the entire periphery of the front wall could be divided into front and rear portions.

The above-described mounting member is a front retainer with deformation prevention portions. However, the invention is applicable to a mounting member with no deformation prevention portion.

The male connector is mounted on the substrate and in the casing in the illustrated embodiment. However, the invention is applicable to a male connector that is not mounted on a substrate or in a casing.

The number of the cavities and the disposition thereof are alterable.

The stop may be formed on the upper surface of the female housing or the side surface thereof instead of the lower part. The number of the stops also may be changed.

What is claimed is:

1. A connector comprising:

a housing having opposite front and rear ends and at least one cavity extending between the ends for receiving a terminal fitting, at least one resiliently deflectable lock formed on the housing and projecting into the cavity for locking the terminal fitting, a front wall substantially at the front end of the housing for defining a front end position of the terminal fitting in the cavity, an insertion opening extending through the front wall for receiving a mating terminal fitting;

a retainer configured for mounting on the front end of the housing, the retainer having a front wall, at least a portion of the front wall being forward of and substantially adjacent to a portion of the front wall of the housing, an insertion opening being formed through the front wall of the retainer for substantial alignment with the insertion opening in the front wall of the housing; and a guide surface sloping in at a front of said insertion opening of said front wall of said retainer and an auxiliary guide surface sloping in at a front of said insertion opening of said front wall of said housing, wherein the guide surface and the auxiliary guide surface guide the mating terminal fitting through the insertion opening in the front wall of the retainer and through the insertion opening in the front wall of the housing.

2. The connector of claim 1, wherein the auxiliary guide surface has a front end and the guide surface has a rear end substantially coincident with the front end of the auxiliary guide surface.

3. The connector of claim 1, wherein the housing has at least one stop disposed and dimensioned to strike the hood when the housings reaches a predetermined normal fit-in depth in the hood.

4. The connector of claim 1, wherein the at least one cavity comprises a plurality of cavities, the portion of the front wall of the retainer being forward of and substantially adjacent to the portion of the front wall of the housing for at least one of said cavities.

5. The connector of claim 4, wherein the cavities comprise a plurality of cavities at an upper stage in the housing and a plurality of cavities at a lower stage in the housing, the portion of the front wall of the retainer being forward of and substantially adjacent to the portion of the front wall of the housing for each of said cavities in the lower stage.

6. The connector of claim 4, wherein at least one of said cavities has a front wall with a first peripheral portion formed entirely by a unitary projection of the housing and a second peripheral portion formed entirely by a unitary projection of the mounting member.

7. The connector of claim 1, wherein the cavity is open between the lock and the front end of the housing, a portion of the front wall of the retainer being disposed forward of the lock.

8. The connector of claim 7, wherein the retainer has a deformation preventing portion for preventing deformation of the lock when the front retainer is in a full locking position on the housing.

9. A connector comprising:

a housing having opposite front and rear ends and a plurality of cavities extending between the ends for receiving a terminal fittings, a front wall substantially at the front end of the housing for defining front end positions of the terminal fitting in the cavities, insertion openings extending through the front wall for receiving mating terminal fittings;

a mounting member configured for mounting on the front end of the housing, the mounting member having a front wall, at least a portion of the front wall being forward of a substantially adjacent to a portion of the front wall of the housing, insertion openings being formed through the front wall of the mounting member for substantial alignment with the insertion openings in the front wall of the housing;

guide surfaces sloping in at a front of said insertion openings of said front wall said mounting member and auxiliary guide surfaces sloping in at a front of said insertion openings of said front wall of said housing, wherein the guide surfaces and the auxiliary guide surface guide the mating terminal fittings through the insertion openings in the front wall of the mounting member and through the insertion openings in the front wall of the housing, at least one of said cavities has a front wall with a first peripheral portion formed entirely by a unitary projection of the housing and a second peripheral portion formed entirely by a unitary projection of the mounting member and wherein a least a second of said cavities has a front wall with a first peripheral portion formed jointly by a unitary projection of the housing and the mounting member and a second peripheral portion formed entirely by a unitary projection of the mounting member.

* * * * *